US008666090B1

(12) United States Patent
Townsend

(10) Patent No.: US 8,666,090 B1
(45) Date of Patent: Mar. 4, 2014

(54) MICROPHONE MODELING SYSTEM AND METHOD

(71) Applicant: Full Code Audio LLC, Redwood City, CA (US)

(72) Inventor: Chris Townsend, Redwood City, CA (US)

(73) Assignee: Full Code Audio LLC, Redwood City, CA (US)

( * ) Notice: Subject to any disclaimer, the term of this patent is extended or adjusted under 35 U.S.C. 154(b) by 0 days.

(21) Appl. No.: 14/064,034

(22) Filed: Oct. 25, 2013

Related U.S. Application Data

(63) Continuation-in-part of application No. 13/776,723, filed on Feb. 26, 2013, now abandoned.

(51) Int. Cl.
*H04R 3/00* (2006.01)

(52) U.S. Cl.
USPC ..... 381/92; 381/111; 381/122

(58) Field of Classification Search
USPC ..... 381/58, 61, 91, 92, 97, 98, 99, 103, 381/111, 112, 113, 114, 115
See application file for complete search history.

(56) References Cited

U.S. PATENT DOCUMENTS

| | | | | |
|---|---|---|---|---|
| 2,179,361 | A | 11/1937 | Von Braumuhl et al. | |
| 4,042,779 | A | 8/1977 | Craven et al. | |
| 4,420,655 | A | 12/1983 | Suzuki | |
| 4,817,168 | A | 3/1989 | Fidi | |
| 4,888,807 | A | 12/1989 | Reichel | |
| 5,193,117 | A | 3/1993 | Ono et al. | |
| 6,810,125 | B2 | 10/2004 | Oster et al. | |
| 7,616,768 | B2 * | 11/2009 | Watson et al. | 381/71.4 |
| 7,817,805 | B1 * | 10/2010 | Griffin | 381/92 |
| 7,970,150 | B2 | 6/2011 | Oxford | |
| 7,970,151 | B2 | 6/2011 | Oxford et al. | |

(Continued)

FOREIGN PATENT DOCUMENTS

| | | | |
|---|---|---|---|
| DE | 4436272 | A1 | 4/1996 |
| EP | 1152637 | A1 | 4/2001 |
| EP | 1737267 | B1 | 6/2005 |

OTHER PUBLICATIONS

"The Eigenmike microphone array", MH Acoustics, San Francisco, CA, US, accessed on the Internet at: http://www.mhacoustics.com/mh_acoustics/Eigenmike_microp hone_array.html on Dec. 12, 2012.

(Continued)

*Primary Examiner* — Vivian Chin
*Assistant Examiner* — Friedrich W Fahnert
(74) *Attorney, Agent, or Firm* — Stone Creek Services LLC; Alan M Flum

(57) ABSTRACT

Disclosed is a system and method with independent adjustment of on and off-axis tonality and a system and method for modeling an idealized off-axis polar response of a directional microphone. The system can include two or more microphone capsules arranged in close proximity within a single housing and a filtering algorithm applied to the output of each microphone capsule that results in a signal that has a predominantly idealized on and off-axis user selectable polar pattern responses and user selectable microphone modeling which models the on-axis frequency response of a physical or virtual microphone. Optionally, the system and method can compensate for the on and off-axis polar response changes due to low-frequency proximity-effect.

24 Claims, 29 Drawing Sheets

(56) References Cited

U.S. PATENT DOCUMENTS

| | | | | |
|---|---|---|---|---|
| 8,284,952 | B2 | 10/2012 | Reining | |
| 2008/0317260 | A1* | 12/2008 | Short | 381/92 |
| 2013/0010982 | A1* | 1/2013 | Elko et al. | 381/94.2 |
| 2013/0044894 | A1* | 2/2013 | Samsudin et al. | 381/92 |
| 2013/0230181 | A1* | 9/2013 | Frey et al. | 381/58 |
| 2013/0230201 | A1* | 9/2013 | Rizzello | 381/332 |

OTHER PUBLICATIONS

Better Digital Wireless, Line 6, Calabasas, CA, accessed on the Internet at: http://line6.com/xd-v/micmodels.html on Dec. 12, 2012.

Polarflex, Schoeps GmBH, Karlsruhe, Germany, accessed on the Internet at: http://www.schoeps.de/en/products/categories/polarflex on Dec. 12, 2012.

Plug-in for RTAS, VST, VST3, AU Polarflex, Schoeps GmBH, Karlsruhe, Germany, accessed on the Internet at: http://www.schoeps.de/en/products/polarflex on Dec. 12, 2012.

Angelo Farina, Andrea Capra, Lorenzo Conti, Paolo Martignon, Filippo Fazi, Measuring Spatial Impulse responses in Concert Halls and Opera Houses Employing a Spherical Microphone Array, Sep. 2007, 19th INternation Congress on Acoustics, Madrid, Spain.

Chirstof Faller, Mihailo Kolundzija, Design and Limitations of Non-Coincidence Correction Filters for Soundfield Microphones, May 2009, Audio Engineering Society Convention Paper 7766, Presented at 126th AES Convention, Munich, Germany, Audio Engineering Society, New York, NY.

Eric Benjamin, Soundfield Microphone using Tangential Capsules, Nov. 2010, Audio Engineering Society Convention Paper 8240, Presented at the 129th AES Convention, San Francisco, CA, Audio Engineering Society, New York, NY.

Mattias Kock, Markus Kock, Rainer Maillard, Malte Kob, Synthesis of polar patterns as a function of frequency with a twin microphone: audio examples and applications within the creative process of music mixing, May 2011, Audio Engineering Society Convention Paper 8365, Presented at the 130th AES Convention, London, England, Audio Engineering Society, New York, NY.

Nils Peters, Andrew W. Schmeder, Beamforming using a spherical microphone array based on legacy microphone characteristics, Nov. 2011, International Conference on Spatial Audio 2011, Gladbach, Germany.

Michael A. Gerzon, The Design of Precisely Coincident Microphone Arrays for Stereo and Surround Sound, Mar. 4, 1975, Presented at the 50th Audio Engineering Society Convention, London England, Audio Engineering Society, New York, NY.

Mic Mod efx Classic Microphone Modeler, Antares Audio Technologies, Scotts Valley, CA, accessed on the Internet at: http://www.antarestech.com/about/contact.shtml on Feb. 15, 2013.

Ron Streicher and Wes Dooley, The Bidirectional Microphone: A Forgotten Patriarch, Journal of the Audio Engineering Society, Mar. 2003, pp. 211-225, vol. 51, No. 4, Audio Engineering Society, NY.

* cited by examiner

MICROPHONE MODELING SYSTEM AND METHOD

This application is a continuation-in-part of U.S. patent application Ser. No. 13/776,723 filed on Feb. 26, 2013.

BACKGROUND

The present disclosure relates microphones and microphone signal processing.

Microphones include a property known as directionality. This property describes the microphone's sensitivity to sound based on the direction of a sound source relative to the front of the microphone. A microphone that is approximately equally sensitive to sound independent of direction of a sound source is known as an omni-directional or non-directional microphone. Microphones whose sensitivity to sound varies according to direction of the sound source is known as a directional microphone. Directional patterns are typically characterized by graphing the microphone's sensitivity to the sound source using a polar graph. Three common directional patterns include cardioid, hyper-cardioid, and figure-eight. A cardioid is so-called because its sensitivity pattern on a polar graph resembles a heart shape. A hyper-cardioid pattern has significantly more sensitivity to a sound source in front of the microphone than the sides or rear of the microphone. A figure-eight pattern, also referred to as a bi-directional microphone pattern, is so-called because its sensitivity pattern on a polar graph resembles the Roman numeral eight. Other types of microphone patterns are possible. These include sub-cardioid, which has nearly even front and side sound source sensitivity with a gradually diminishing sensitivity in areas behind the microphone.

There is great utility in being able to use microphones with different sensitivity patterns. For example, a microphone with a cardioid can be used advantageously for capturing live vocal performances. Because a microphone with a cardioid directional pattern is primarily sensitive to sound coming from the front and partially from the sides of the microphone, the microphone will capture primarily the vocal performance while minimizing extraneous sounds such as the drums, audience, stage-monitor speakers, or other instruments.

Most directional microphones achieve their stated directional sensitivity, known as their "polar response pattern", over a limited portion of the audio spectrum. For example, a microphone with a cardioid polar response pattern may actually have a cardioid directional pattern only over a limited frequency range, for example, 200 Hertz (Hz) to 2 kilo Hertz (kHz). At frequencies outside of this range, the microphone may exhibit a sub-cardioid, hyper-cardioid, or even omni-directional polar pattern. This may cause undesirable leakage of sound from other undesired sound sources. For example, in an audio recording studio, a drum kit often has a separate microphone for each drum and cymbal so that the sound engineer can control the level of each drum and cymbal separately on an audio mixing board. A cardioid microphone used to pickup the sound from a snare drum only, may receive sound leakage from a nearby hi-hat cymbal in a higher frequency range where the microphone no longer exhibits a cardioid pattern. This sound leakage when mixed with the sound from the hi-hat microphone may cause an undesirable coloration of the hi-hat's sound.

In addition, directional microphones are optimized for fidelity and frequency response for sound originating from the front of the microphone capsule or "on-axis." Directional microphones are designed to maximize rejection of sound outside of their desired pattern or alternatively, "off-axis" from the front of the microphone capsules. This characteristic can come at the expense of sound fidelity. For example, the off-axis frequency response in one or more particular directions may vary dramatically, often by more than 20 decibels (dB), which can color the sound in an undesirable and unnatural way.

Microphones can be manufactured with two or more user selectable polar response patterns. For example, a microphone may allow the user to select an omni-directional pattern, a figure-eight pattern, or a cardioid pattern. Microphone with adjustable polar patterns can exhibit worse off-axis coloration due to compromises in their design that are required to support multiple patterns in a single microphone.

SUMMARY

Disclosed is a method, apparatus, and system that attempts to overcome the aforementioned problems by allowing a user to adjust on-axis tonality or frequency response independent of the off-axis polar pattern and provides the possibility of an improved or idealized off-axis frequency response. For example, users can select or adjust the microphone's polar pattern while minimizing changes to the on-axis frequency response. The user can select a modeled microphone with a specific and generally desirable on-axis frequency response. The off-axis frequency response can be relatively flat and be independent of the polar-pattern selected. The user can select a modeled microphone with a non-ideal on-axis frequency response, while maintaining an off-axis frequency response that is relatively flat. Proximity-effect compensation can be applied to minimize the effect of proximity-effect to both on and off-axis frequency response and polar patterns, or to match the proximity-effect characteristics of a modeled microphone. If in some applications the user may desire to not use idealized polar response then in that case it is possible to emulate the full polar response of the modeled microphone.

In one aspect, a system and method capable of producing idealized polar patterns and user selectable microphone models can include a microphone with back-to-back cardioid capsules and a pair of beamforming filters for shaping the microphone signals into a user selected polar pattern. The beamforming filters can be implemented with optimizations techniques, such as minimax, least squares, or genetic algorithms. The coefficients of the beamforming filters are mapped from a lookup table that includes coefficient values for each corresponding polar pattern. An on-axis model filter alters the frequency response of the resulting summed output of both beamforming filters so that the on-axis frequency response matches that of a modeled microphone at any particular on or off-axis, angle of incidence. Using a user microphone control, the user can emulate a classic microphone or other desired frequency response characteristic. A lookup table that includes sets of coefficients corresponding to each modeled microphone maps the coefficients from a user control to the on-axis model filter.

A system and method capable of producing idealized polar patterns and user selectable microphone models can also be implemented with a microphone that includes back-to-back cardioid capsules, a pair of beamforming filters, and a two-dimensional lookup table. Each beamforming filter receives a signal from a corresponding microphone capsule and the resultant outputs of both beamforming filters are summed. Each cell of the lookup table includes a set of coefficients corresponding to a user-selected microphone and a user-selected polar pattern.

Proximity-effect compensation can be implemented in a system or method capable of producing idealized polar patterns and user selectable microphone models by convolving a plurality of beamforming filters with a high frequency on-axis filter and the sum of a high frequency and a low frequency crossover filters. Alternatively, proximity-effect compensation can be implemented by creating a high frequency component of the idealized on-axis and off-axis polar response in combination with creating a low frequency component of a user selected microphone model, apply a microphone model filter high frequency component, and summing the resultant output of the microphone model filter with the low frequency component.

Proximity-effect compensation can be implemented in a system or method capable of producing idealized polar patterns and user selectable microphone models where the user can inform the system of the approximate distance the microphone is from the signal source through one or more user controls. For example, user controls can include a single distance control or a pair of on-axis and off-axis distance controls. The system can map the user distance selection to coefficient sets that emulate the modeled microphone at various distances. There are several variations of proximity effort compensation using user controls discussed in the Description section of this disclosure.

This Summary introduces a selection of concepts in simplified form that are described in more detail in the Description. The Summary is not intended to identify essential features or limit the scope of the claimed subject matter.

DRAWINGS

Figure 11A:
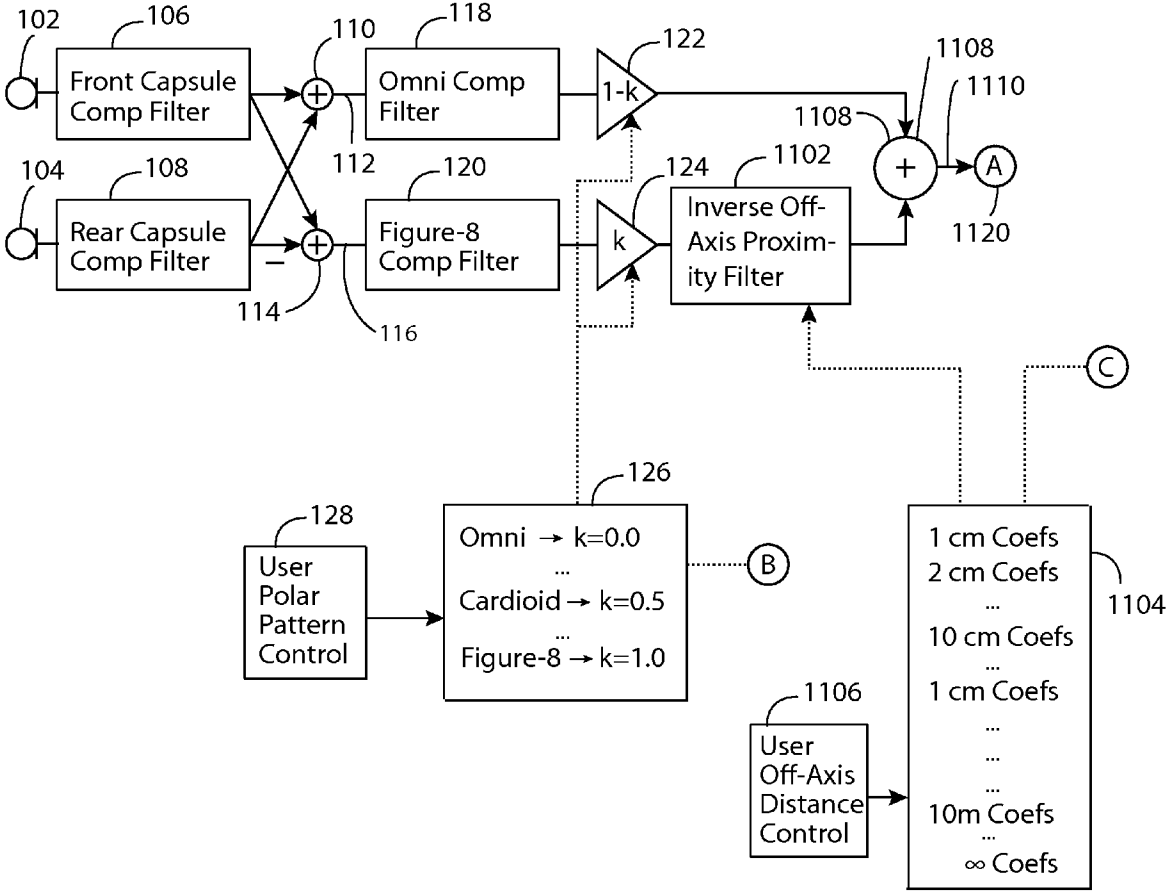
Figure 11B:
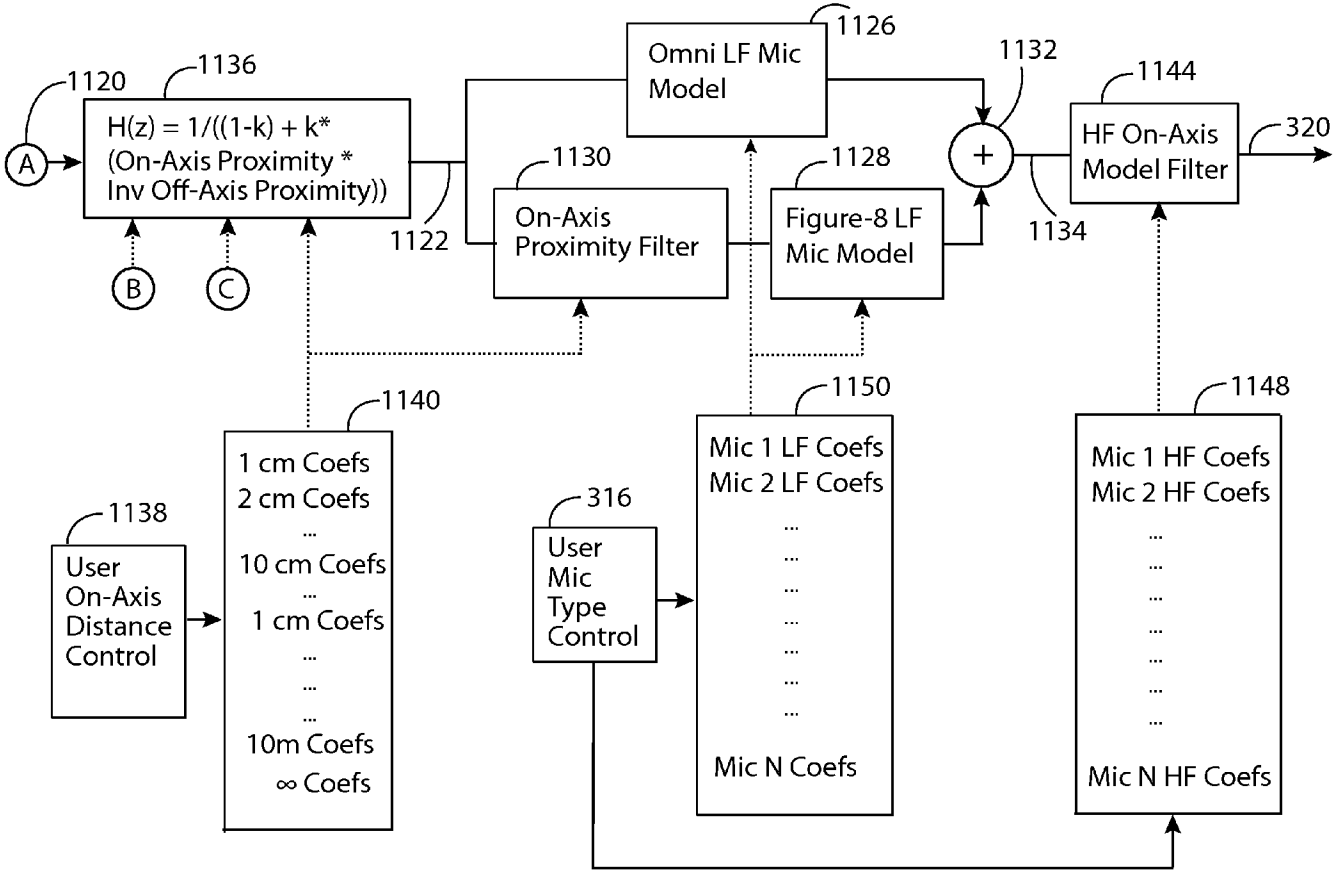

FIGS. 11A-B shows a system and method capable of producing idealized polar patterns and user selectable microphone models with proximity correction at user selectable on and off-axis distances.

Figure 12A:
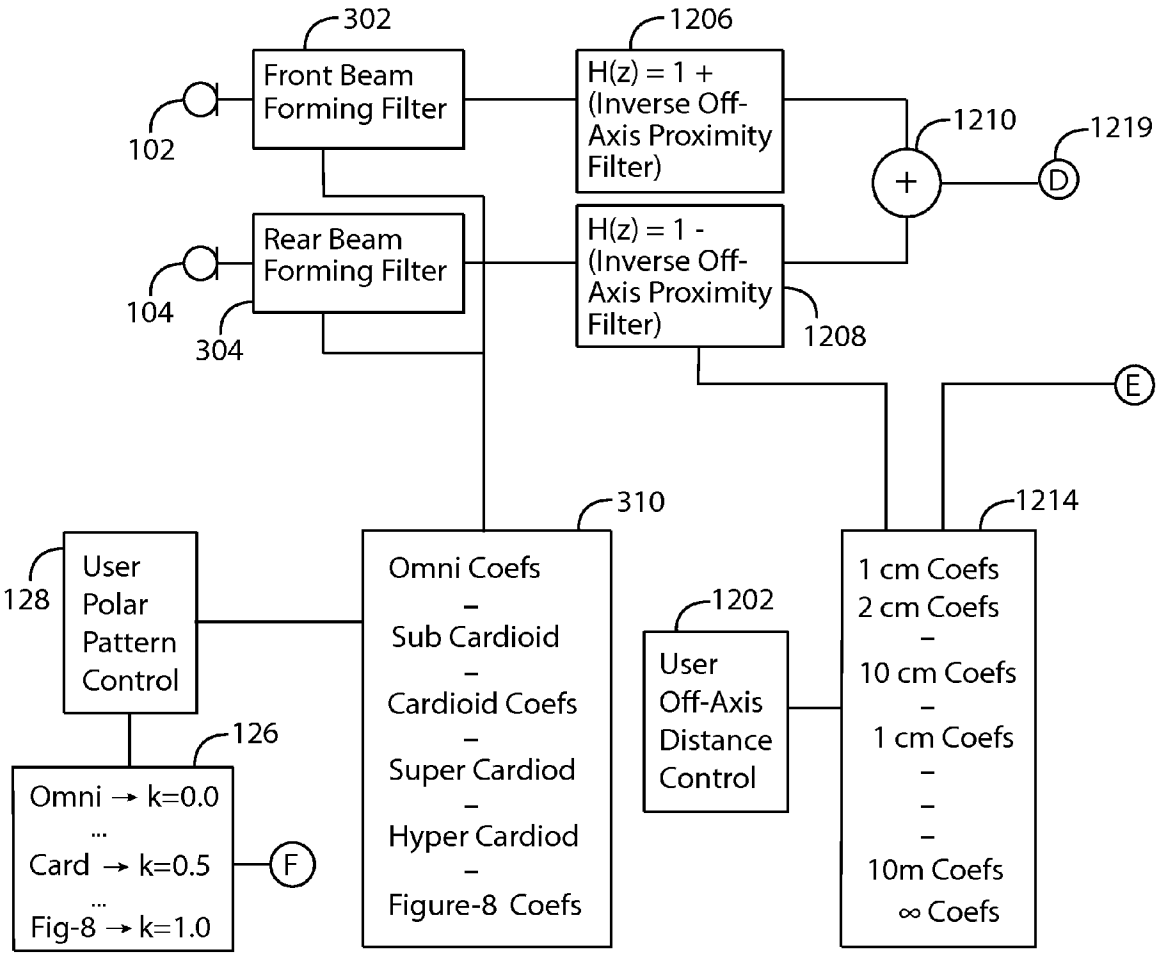
Figure 12B:
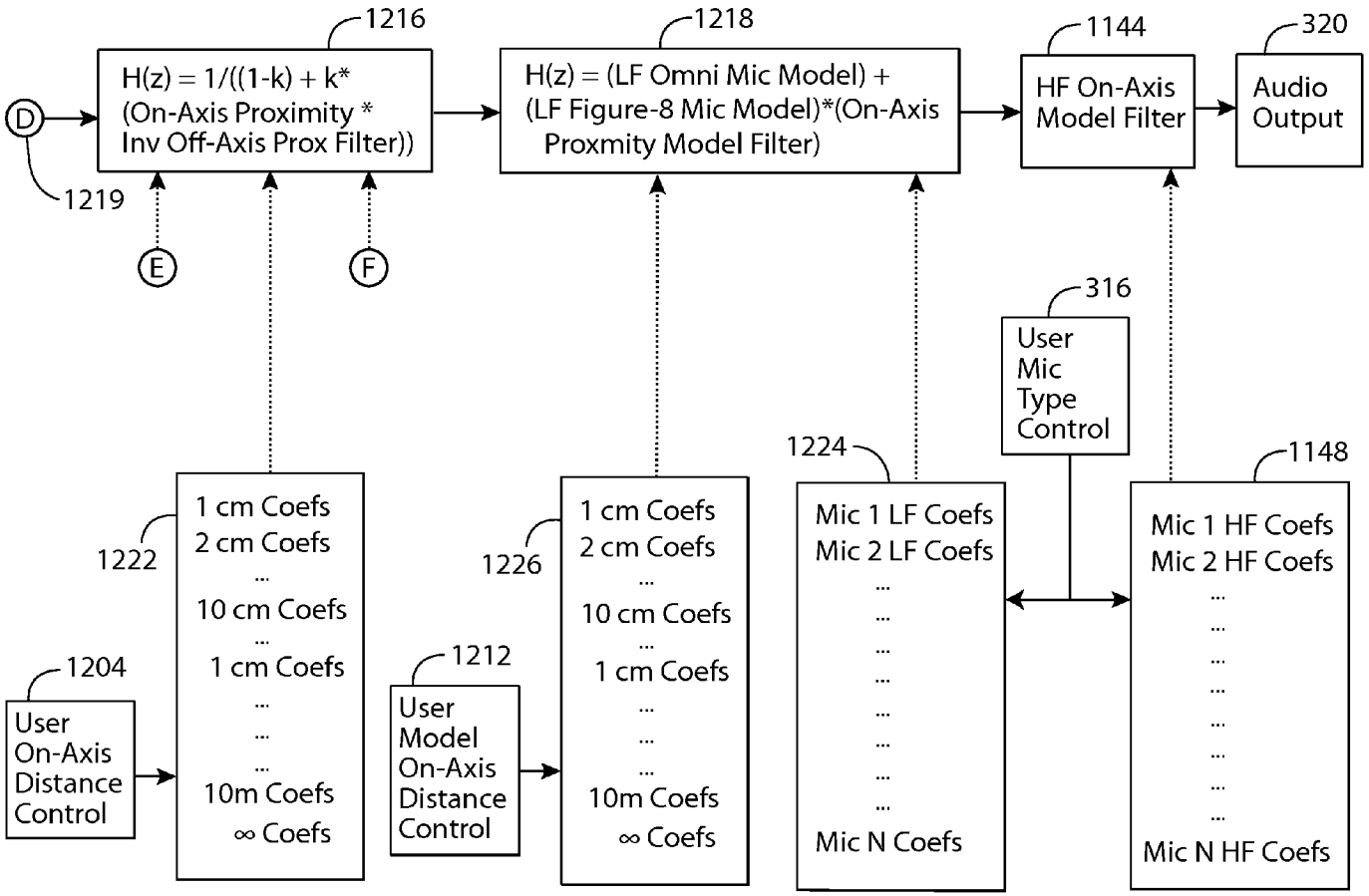

FIGS. 12A-B shows a system and method capable of producing idealized polar patterns and user selectable microphone models utilizing beamforming filters, an on-axis microphone modeling filter, and proximity-effect correction.

Figure 13:
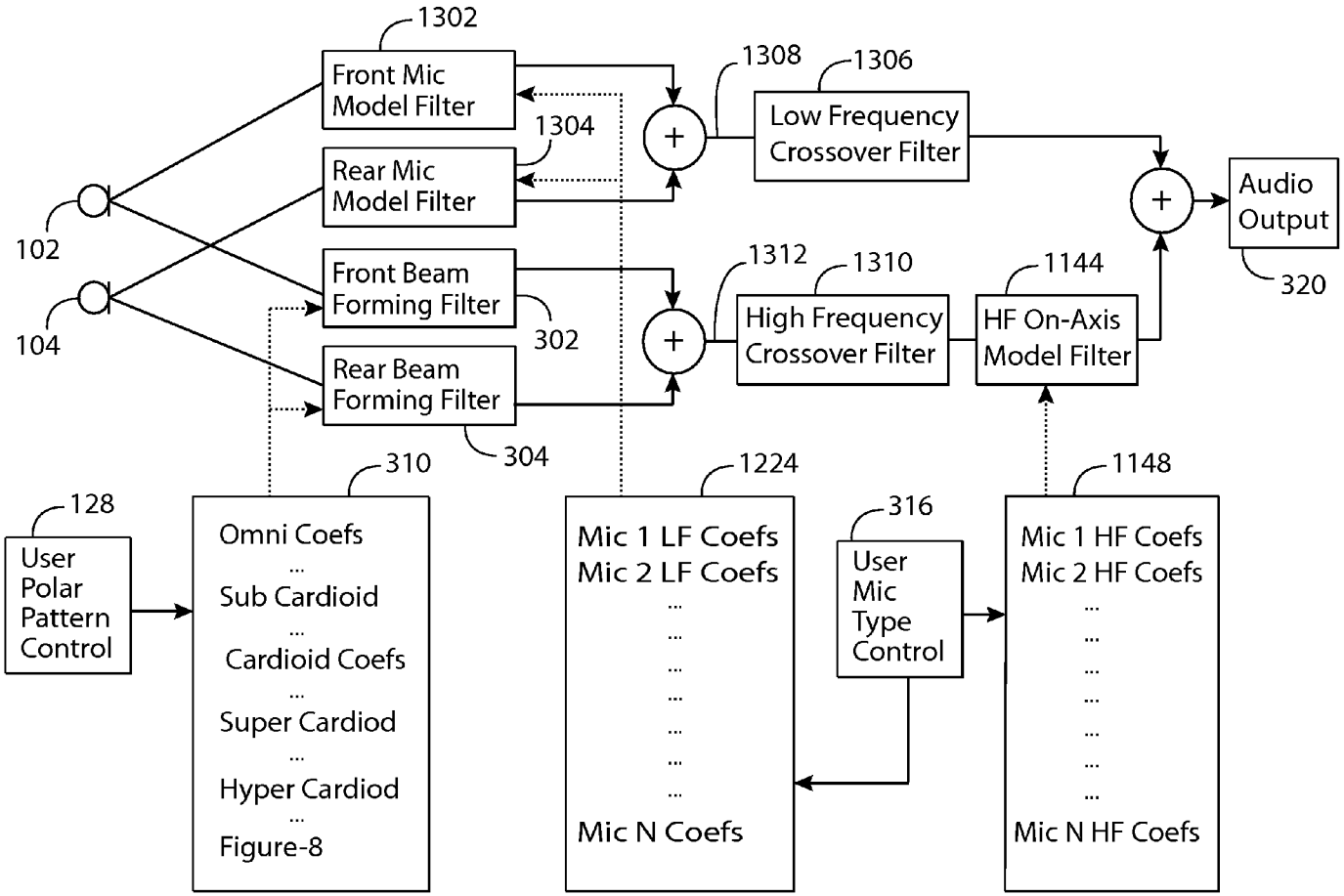

FIG. 13 shows a system and method capable of producing idealized polar patterns and user selectable microphone models with proximity-effect compensation.

Figure 14:
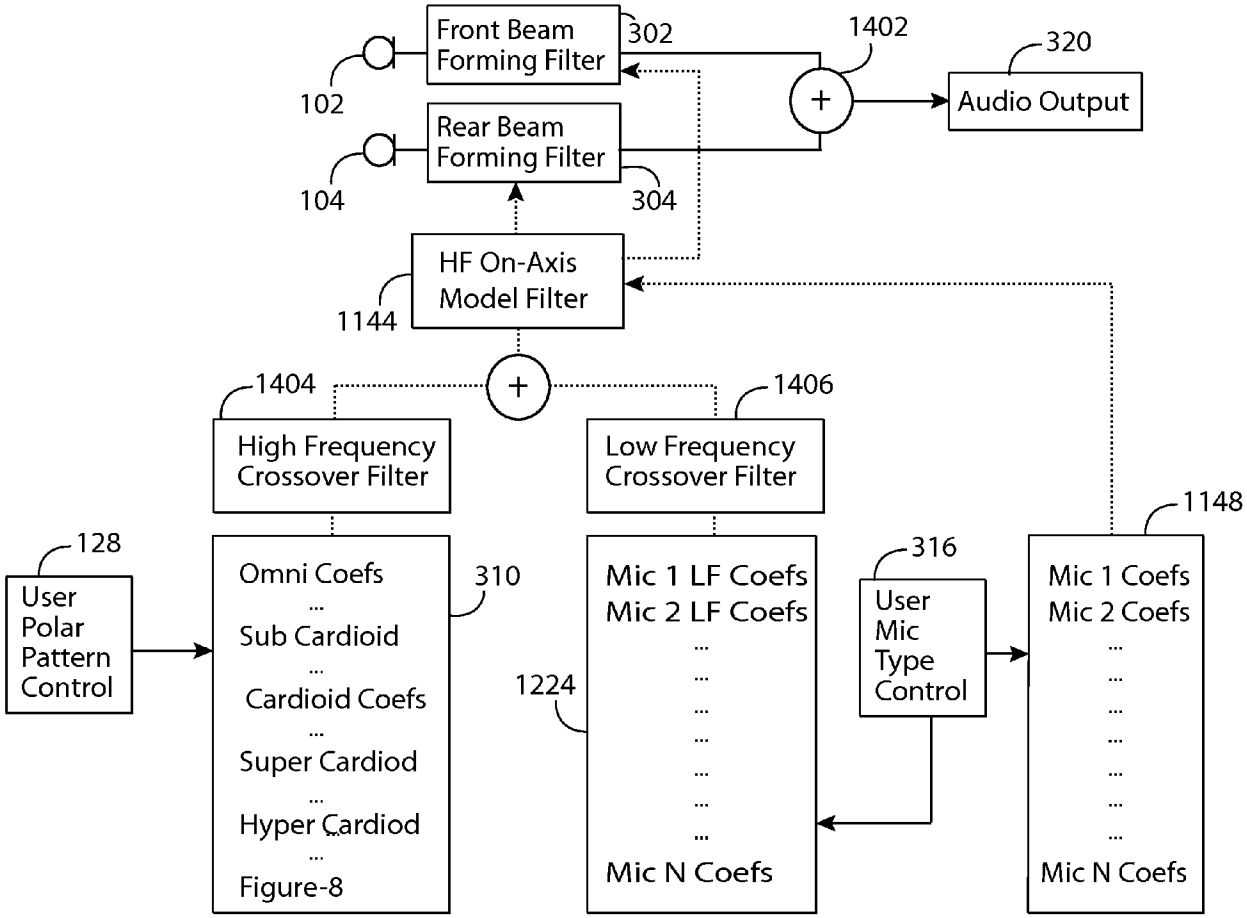

FIG. 14 shows a system and method capable of producing idealized polar patterns and user selectable microphone models with automatic proximity correction.

Figure 15A:
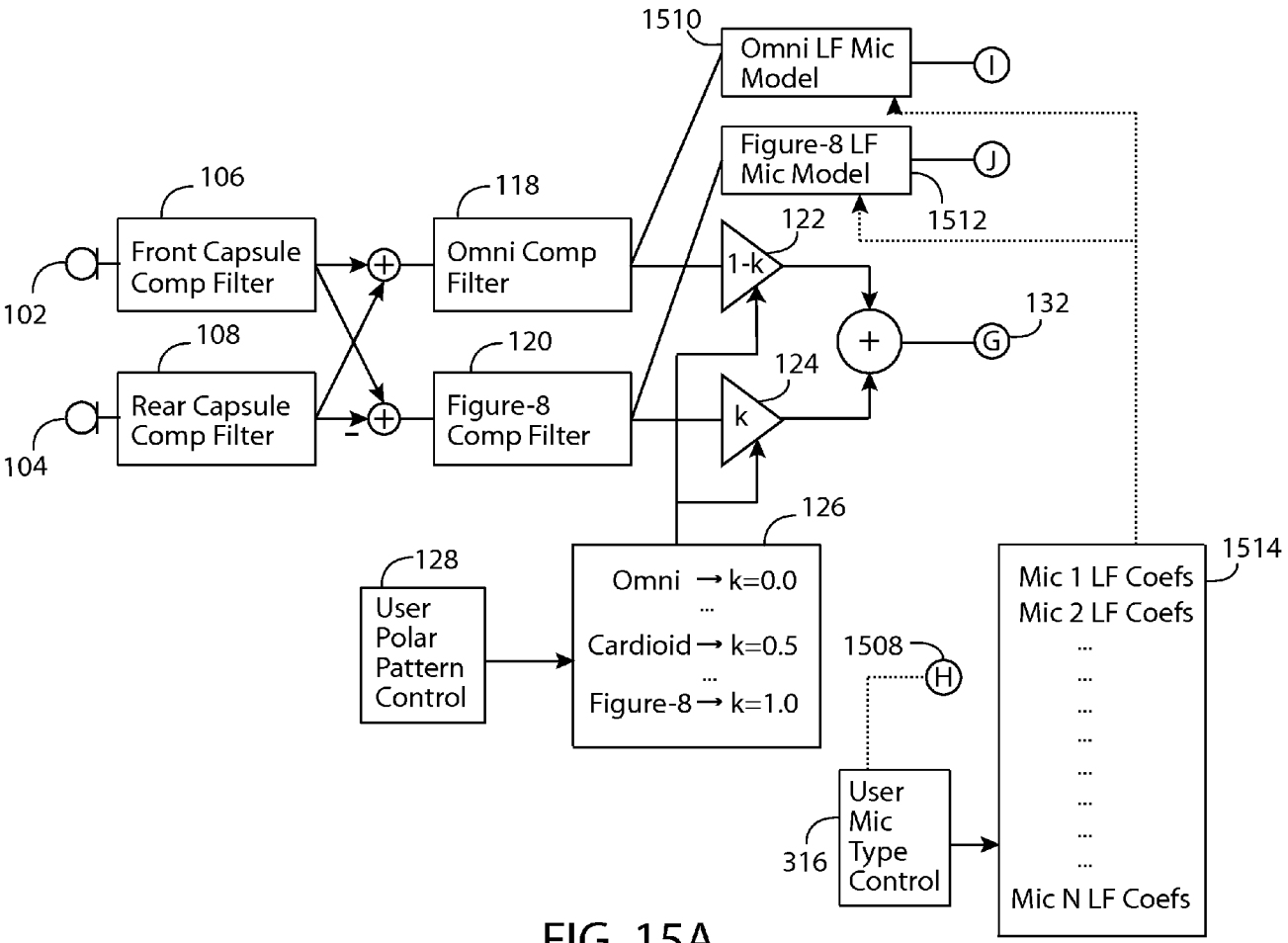
Figure 15B:
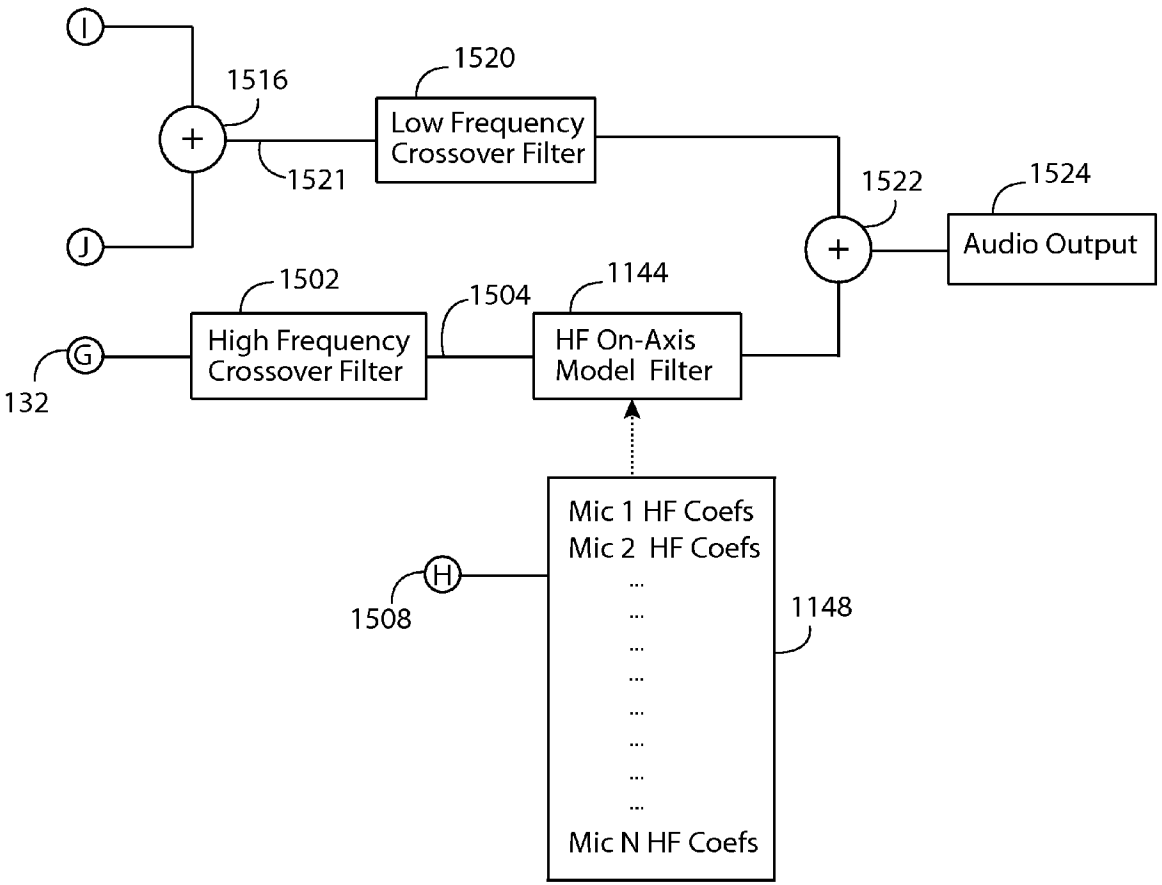

FIGS. 15A-B show a system and method capable of producing idealized polar patterns and user selectable microphone models with automatic proximity correction where the microphones signals are converted to omni-directional and figure-eight polar patterns before further processing.

Figure 16A:
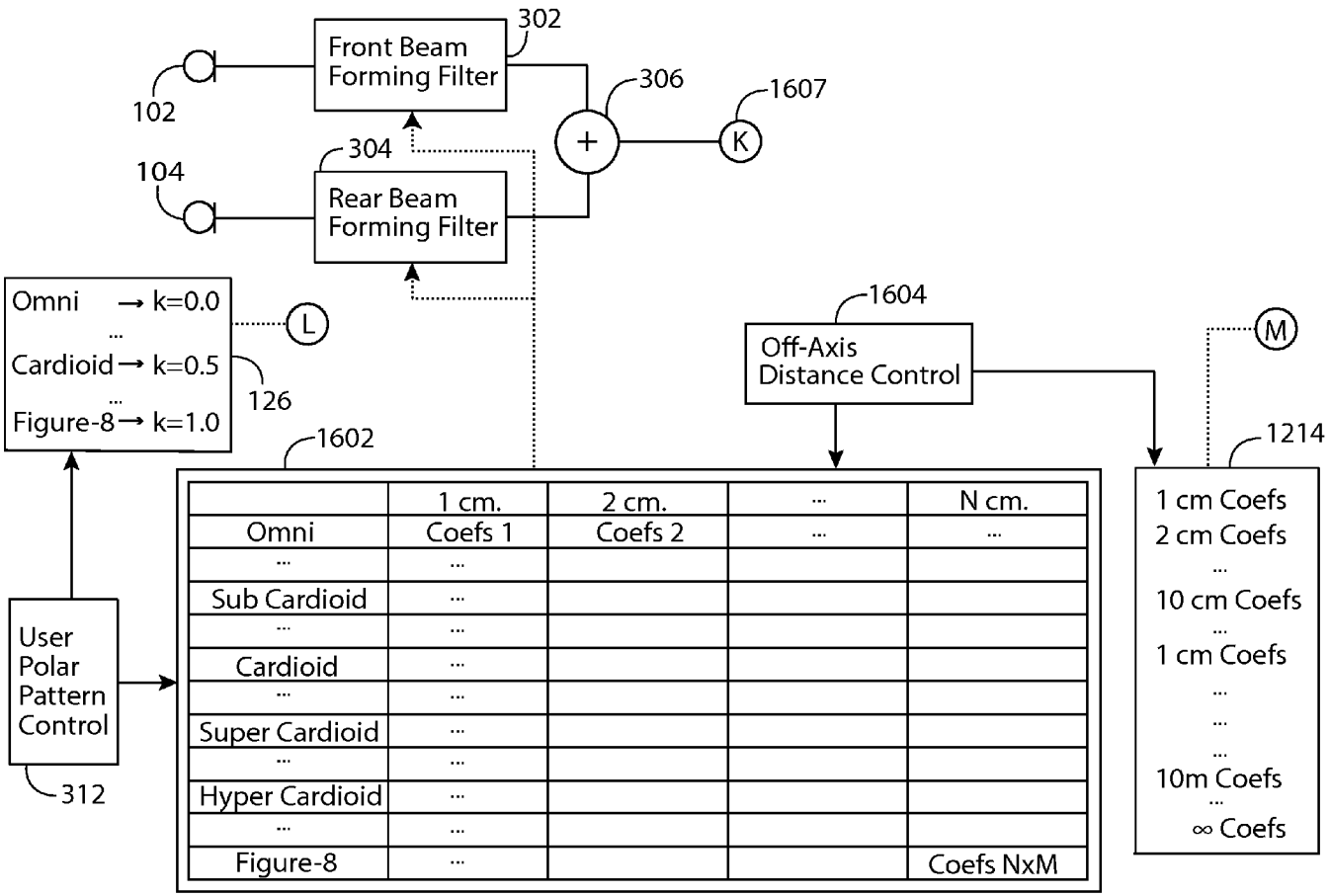
Figure 16B:
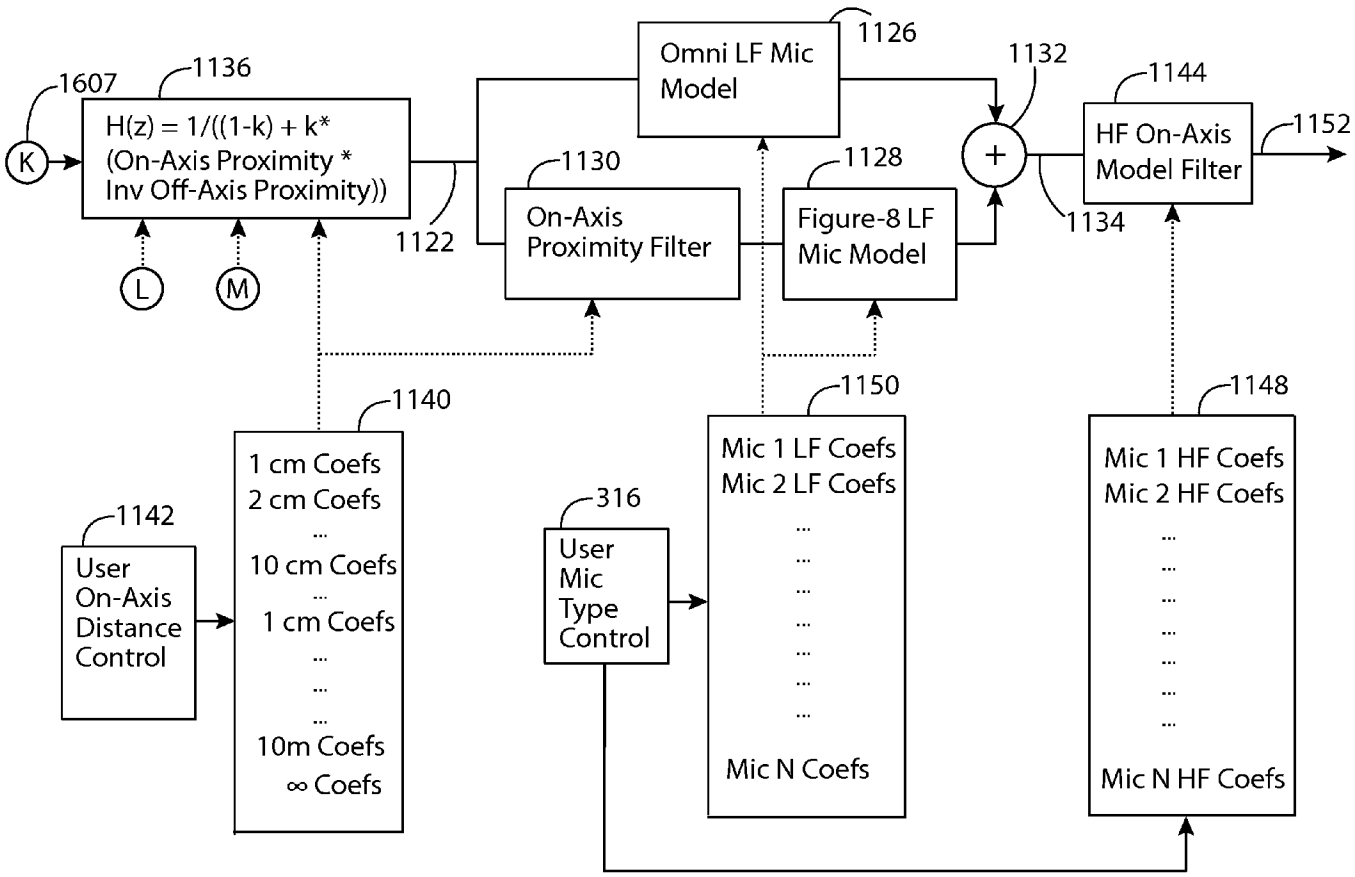

FIGS. 16A-B shows a system and method capable of producing idealized polar patterns and user selectable microphone models with full proximity compensation utilizing a two dimensional lookup table.

Figure 17:
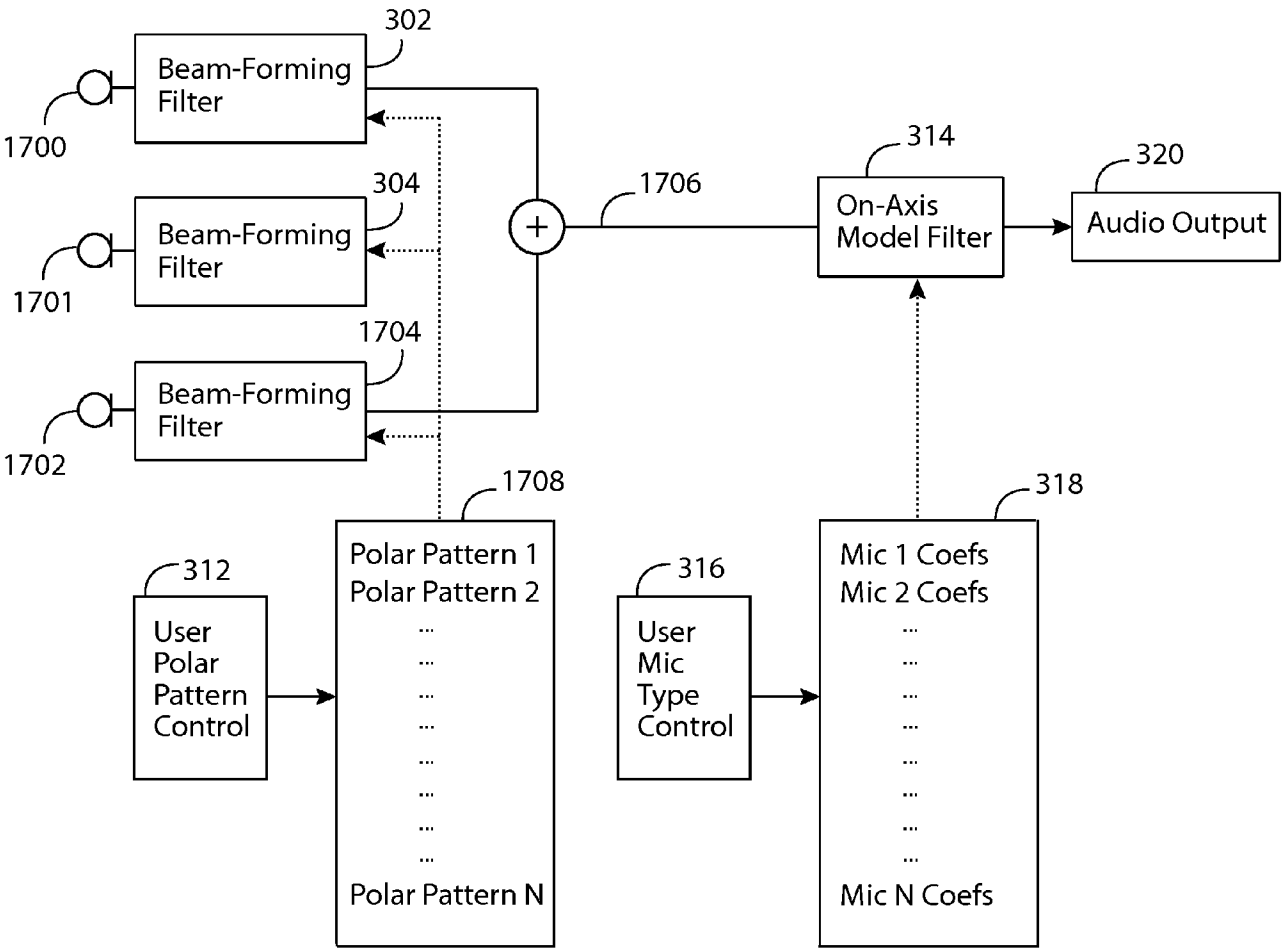

FIG. 17 shows a system and method capable of producing idealized polar patterns and user selectable microphone models utilizing three microphone capsules.

Figure 18A:
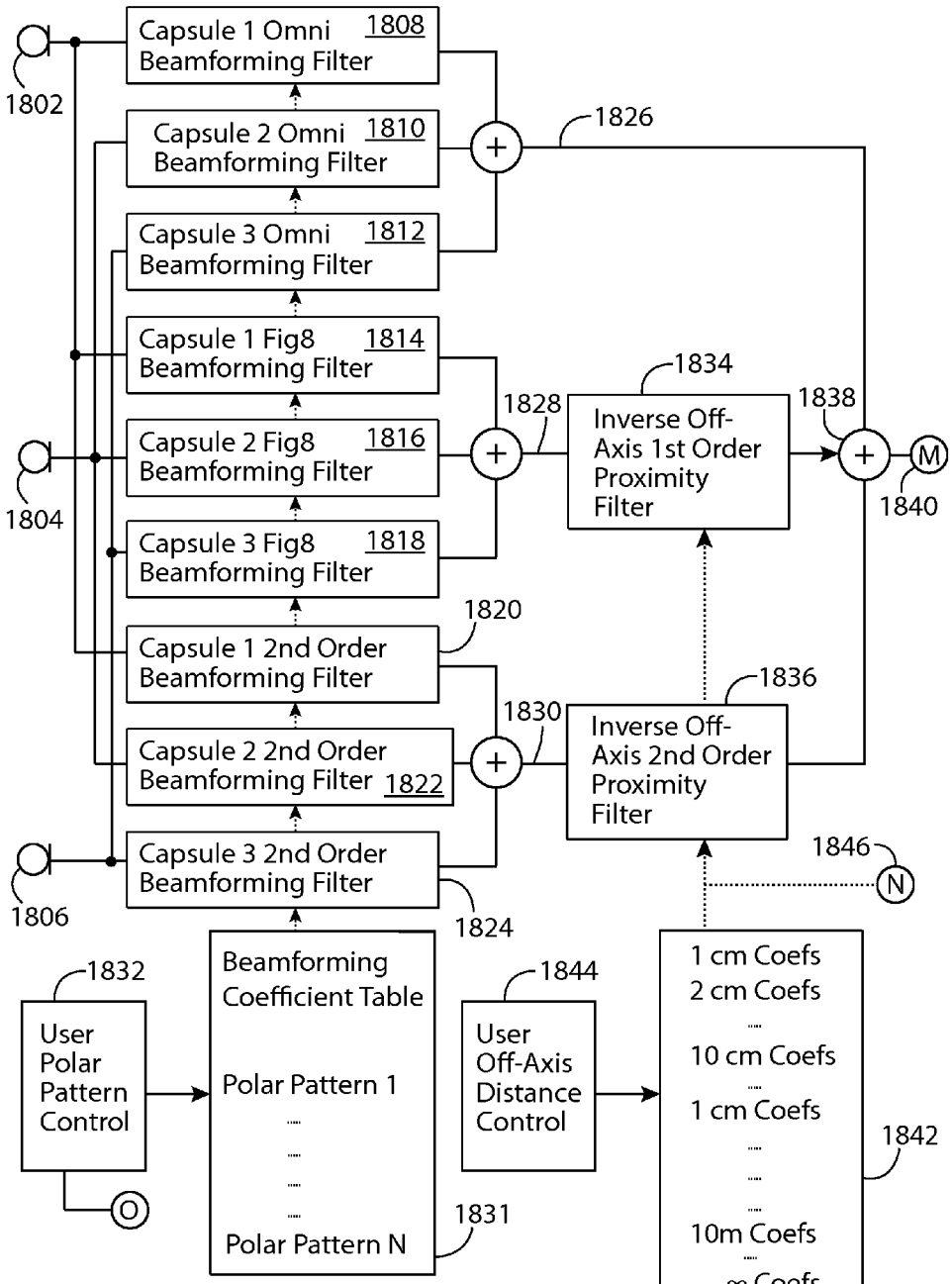
Figure 18B:
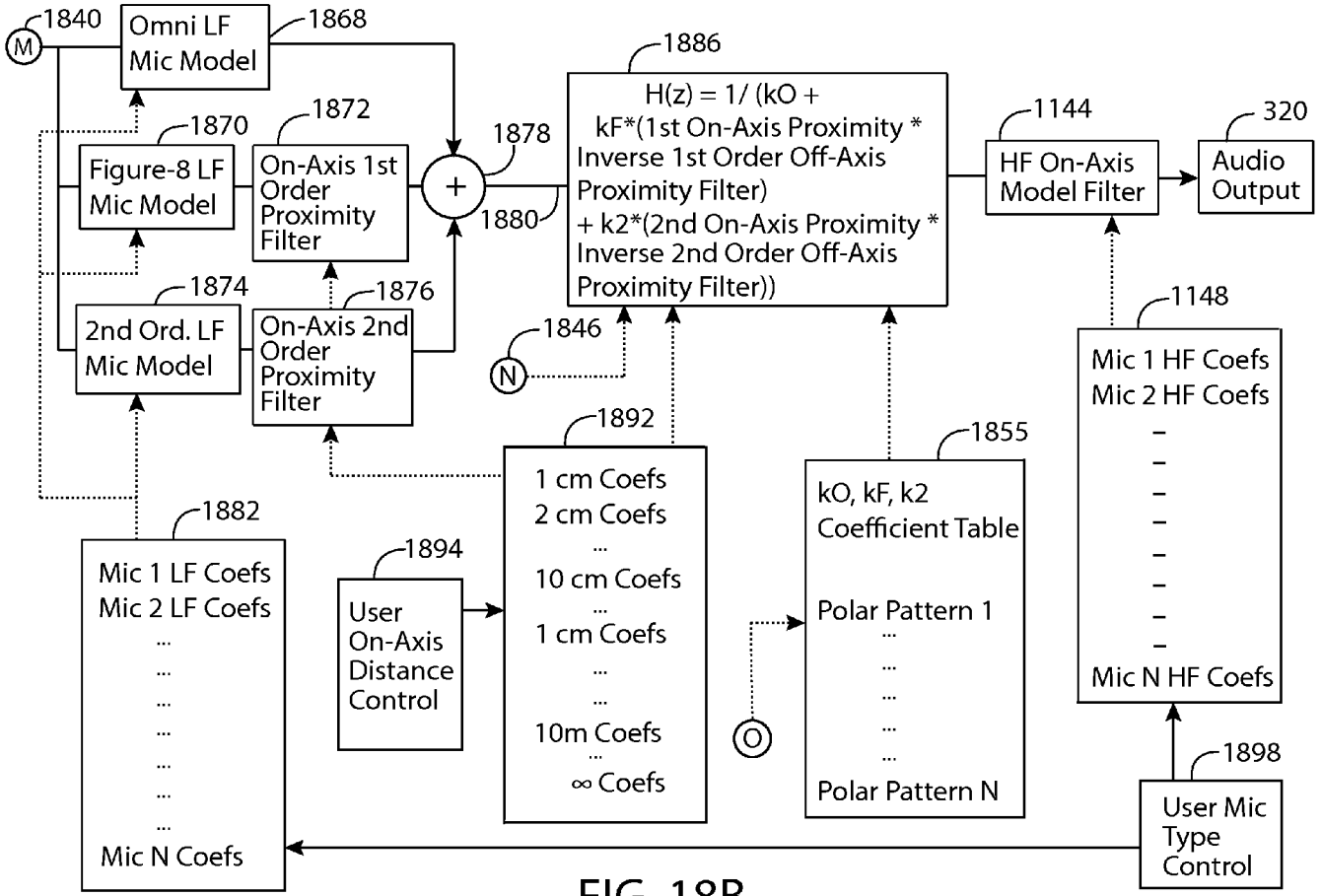

FIGS. 18A-B shows a system and method capable of producing idealized polar patterns and user selectable microphone models with proximity correction utilizing three microphone capsules.

Figure 19:
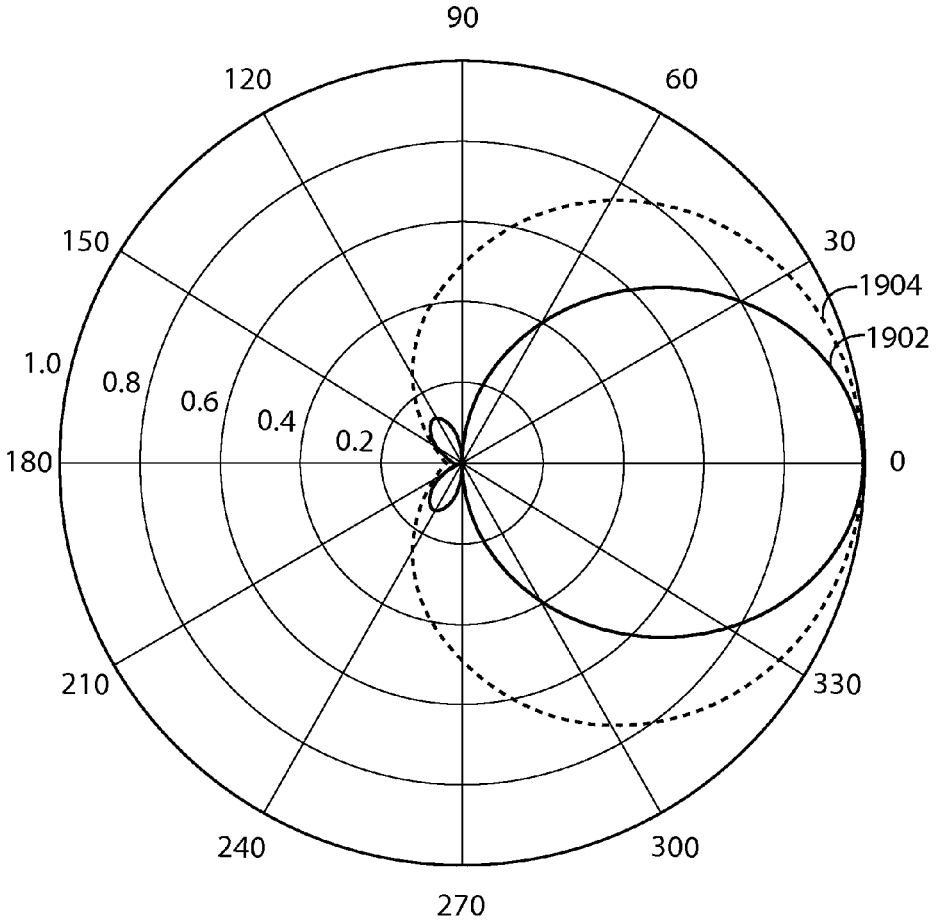

FIG. 19 shows a polar plot of a second order polar pattern in comparison to a polar plot of a cardioid polar pattern.

Figure 20:
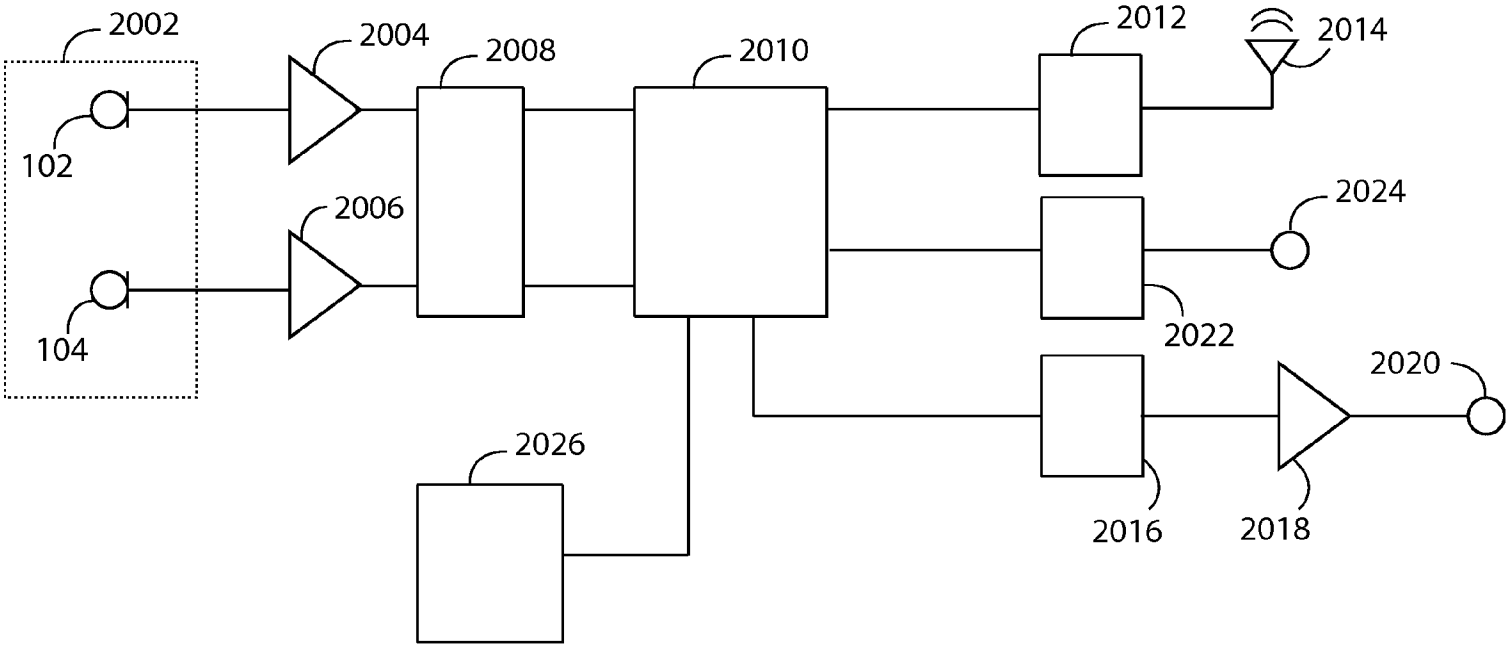

FIG. 20 illustrates a simplified hardware block diagram capable of implementing the system and method of FIGS. 3-20.

Figure 21:
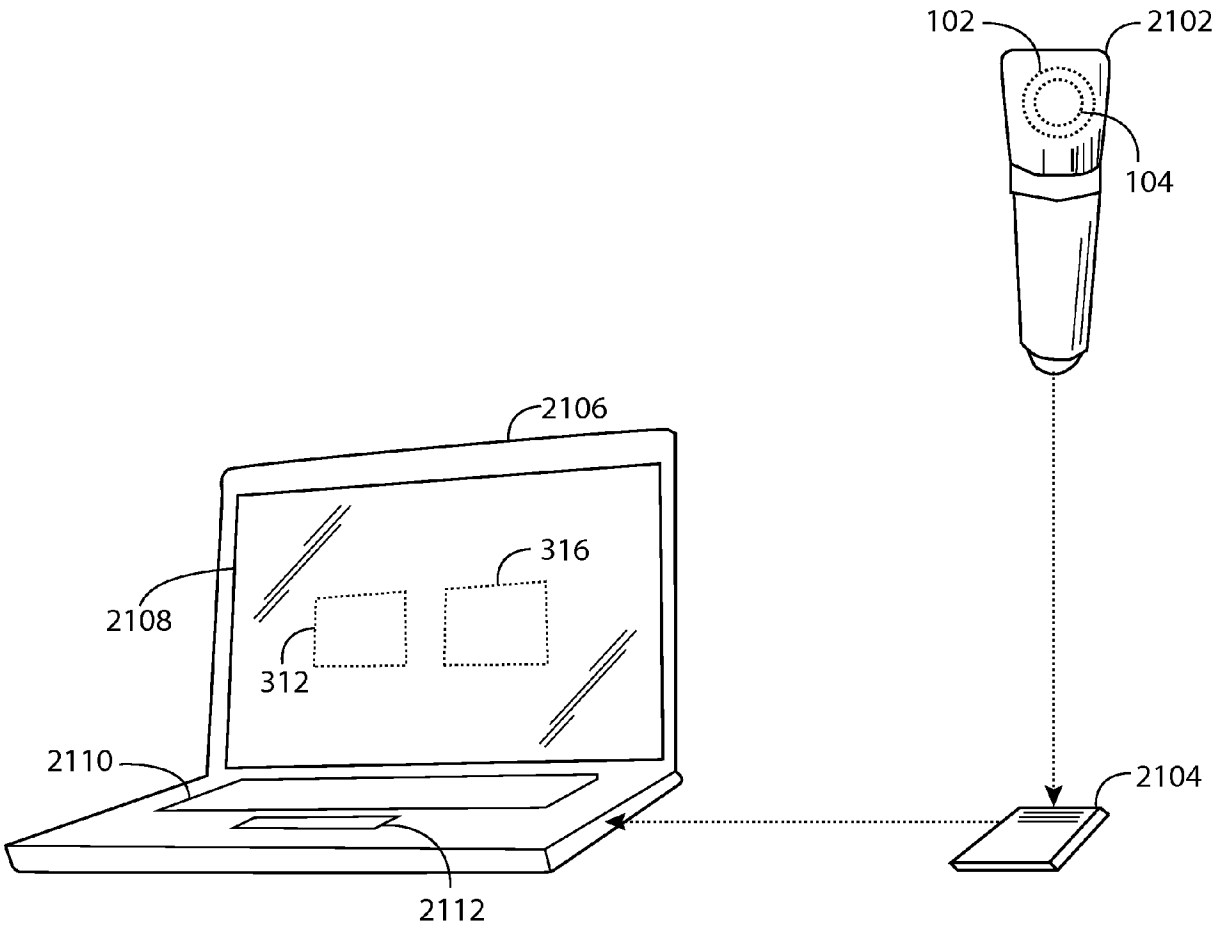

FIG. 21 shows an a system capable of producing idealized polar patterns and user selectable microphone models of FIGS. 3-20 implemented with software running on a personal computer in combination with an external microphone.

Figure 22:
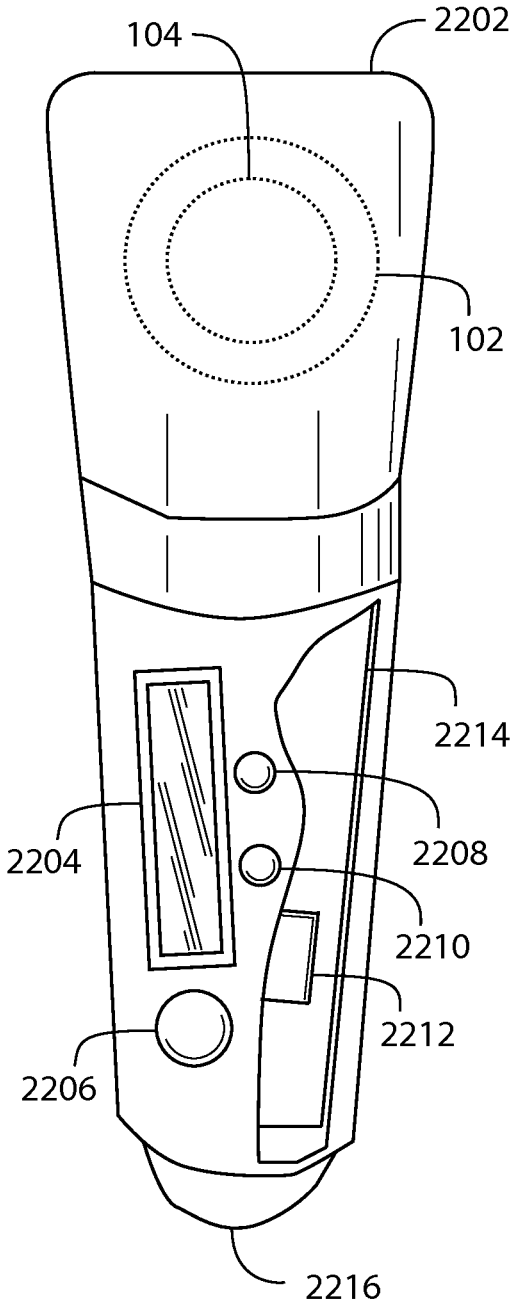

FIG. 22 shows a microphone capable of implementing the systems and methods of FIGS. 3-18.

Figure 23:
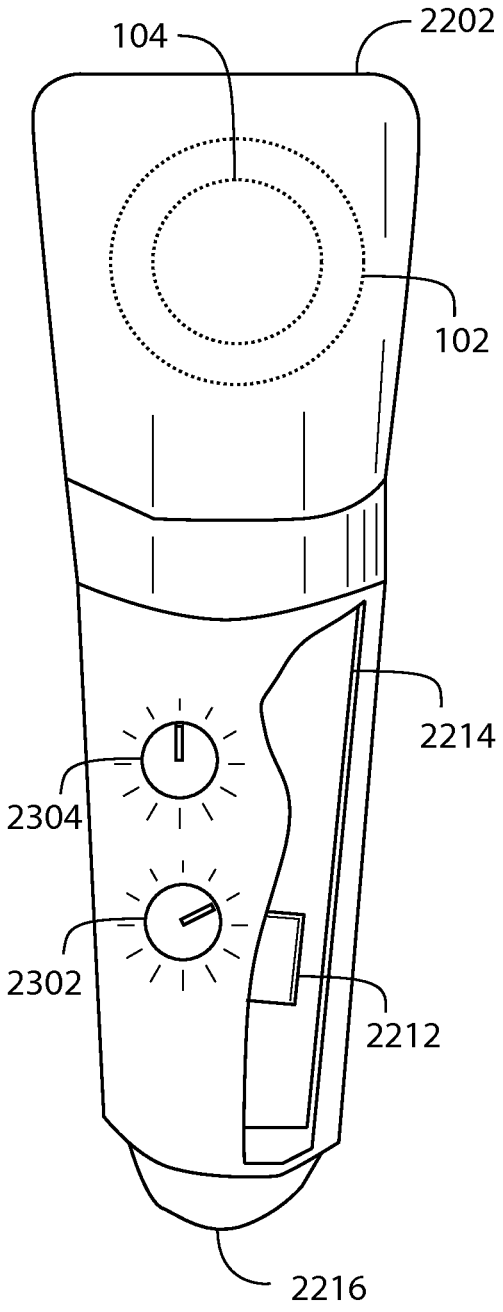

FIG. 23 shows a microphone capable of implementing the systems and methods of FIGS. 3-18.

DESCRIPTION

Figure 1:
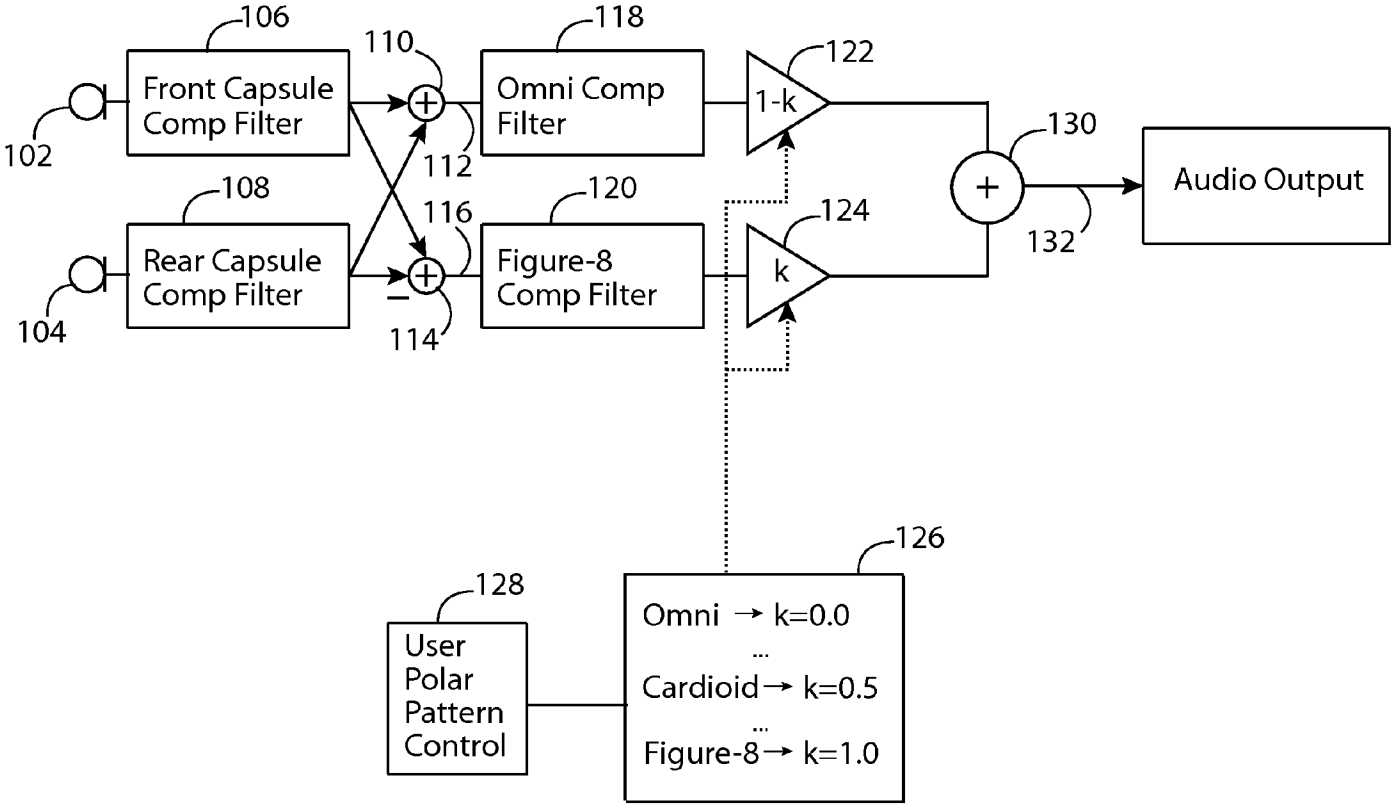
FIG. 1 PRIOR ART
FIG. 1 shows a system for creating user selectable microphone polar patterns in the prior art.

The following description is made with reference to figures, where like numerals refer to like elements throughout the several views, FIG. 1 shows a system and method for creating user selectable microphone polar patterns in the prior art. Referring to FIG. 1, two cardioid microphone capsules, a front capsule 102 and a rear capsule 104 are placed back-to-back. This can be implemented in what is known in the art as a Braunmuhl and Weber dual diagram capsule design. Placing the capsules as coincidentally as possible can minimize high frequency polar response errors. For example, the capsules can be placed within some fraction of a wavelength of the highest frequency to be reproduced. For a 20 kHz bandwidth about 5 millimeters (0.2 inch) is generally adequate.

A first compensation filter 106, labeled "Front Capsule Comp Filter", processes the output signal of the front capsule 102 and a second compensation filter 108, labeled "Rear Capsule Comp Filter", processes the output signal of the rear capsule 104. The output of the first compensation filter 106 and the output of the second compensation filter 108 are summed 110 to form an omni-directional polar pattern signal 112. The output of the first compensation filter 106 and the inverse of the output of the second compensation filter 108 are summed 114 to form a figure-eight polar pattern signal 116. A third compensation filter 118, labeled "Omni Comp Filter," corrects frequency response and polar pattern non-idealities from omni-directional polar pattern signal 112. A fourth compensation filter 120, labeled "Figure-8 Comp Filter" corrects frequency response and polar pattern non-idealities from the figure-eight polar pattern signal 116. The resulting outputs of the compensation filters have a substantially flat on-axis response so that changing the polar pattern does not significantly affect the on-axis frequency response.

A first linear gain stage 122 with a gain of 1−k receives the signal from the output of the third compensation filter 118. A second linear gain stage 124 with a gain of k receives the signal form the output of the fourth compensation filter 120. The gain of the first linear gain stage 122 and the second linear gain stage 124 are determined by the value of k mapped from a polar pattern lookup table 126. The polar pattern lookup table 126 selects the value of k based on a user polar pattern control 128. The user polar pattern control 128 is typically a physical control such as a knob or switches or can be a virtual control on a graphical user interface.

The output of the first linear gain stage 122 and the second linear gain stage 124 are summed 130. Depending on the value of k, a summed signal 132, labeled "audio output", can have an omni-directional, cardioid, figure-eight, or other polar response patterns. For example, if the user selects an omni-directional polar pattern using the user polar pattern control 128, then the polar pattern lookup table 126 selects k=0. The first linear gain stage 122 would have a gain of 1 and the second linear gain stage 124 would have a gain of 0. The summed signal 132 resulting, would have an output entirely from the first linear gain stage 122, and therefore an omni-directional polar pattern.

If the user selects "figure-eight polar pattern" using the user polar pattern control 128, then the polar pattern lookup table 126 selects k=1. The first linear gain stage 122 would have a gain of 0 and the second linear gain stage 124 would have a gain of 1. The summed signal 132 resulting would have an output entirely from the second linear gain stage 124, and therefore a figure-eight polar pattern.

If the user selects a cardioid polar pattern using the user polar pattern control 128, then the polar pattern lookup table 126 selects k=0.5. The first linear gain stage 122 would have a gain of 0.5 and the second linear gain stage 124 would have a gain of 0.5. The summed signal 132 resulting would have an output with equal contributions from the first linear gain stage 122 and the second linear gain stage 124. The resulting summed signal 132 is a cardioid polar pattern.

The Braunmuhl and Weber dual diagram capsule design is commonly found in multi-pattern large diaphragm condenser microphones available commercially. In many of the multi-pattern large diaphragm condenser microphones utilizing the Braunmuhl and Weber arrangement, the front capsule 102 and the rear capsule 104 of FIG. 1 are combined directly without compensation filters by analog summing or subtracting to form omni-directional and figure-eight polar pattern signals respectively. Using a selector switch, the user can choose a cardioid, omni-directional, or figure-eight polar pattern output signal.

Figure 2A:
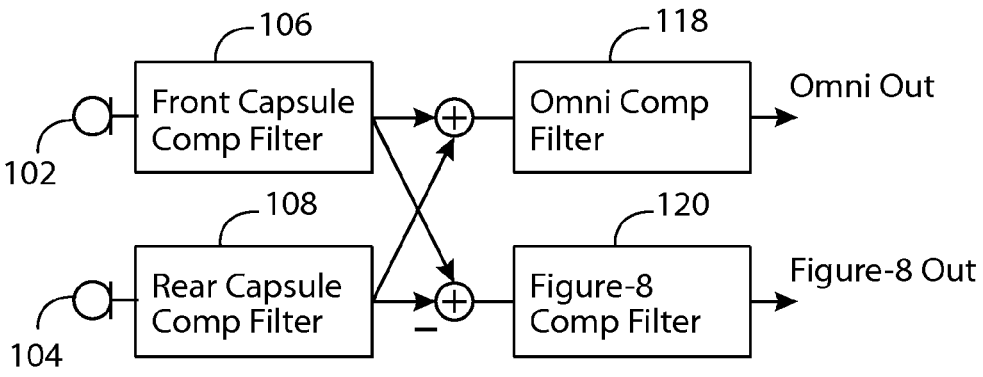
FIG 2A PRIOR ART
FIGS. 2A-2D show microphone capsule filter compensation topologies in the prior art.

FIGS. 2A-2D shows several microphone capsule filter compensation topologies in the prior art. The first compensation filter 106, the second compensation filter 108, the third compensation filter 118, and the fourth compensation filter 120, the front capsule 102, and the rear capsule 104 from FIG. 1 in the illustrated arrangement together constitute a capsule compensation topology and is shown in FIG. 2A.

Figure 2B:
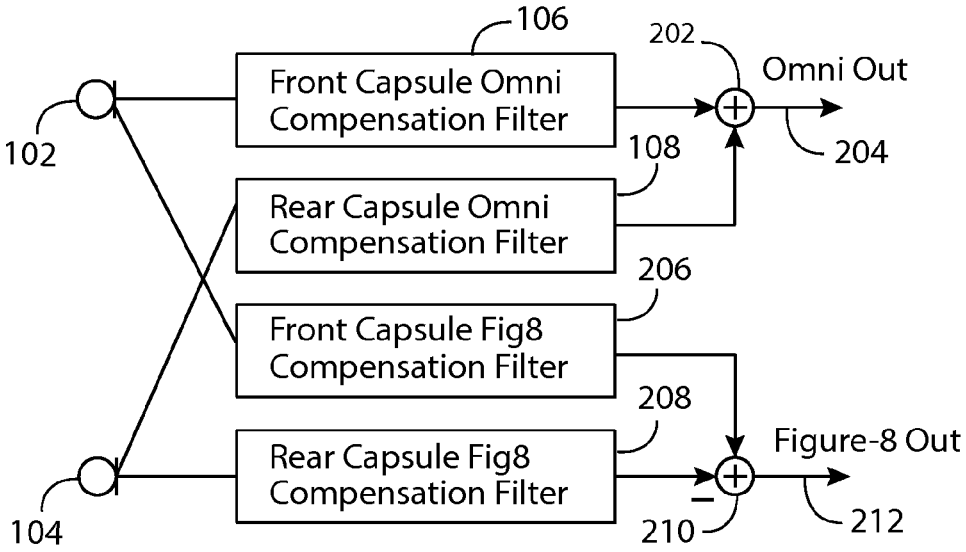
FIG 2B PRIOR ART

FIG. 2B shows a more generalized capsule compensation topology for back-to-back cardioid microphones in the prior art. The first compensation filter 106 filters a portion of the signal from the front capsule 102. The second compensation filter 108 filters a portion of the signal from the rear capsule 104. The signal from the first compensation filter 106 and the second compensation filter 108 are summed 202. The summed signal 204 that results has an omni-directional polar pattern. A third compensation filter 206 filters the remaining portion of the signal from the front capsule 102. A fourth compensation filter 208 filters the remaining portion of the signal from the rear capsule 104. The signal from the third compensation filter 206 is summed with the inverse of the fourth compensation filter 208 are summed 210. The summed signal 212 that results has a figure-eight output.

Figure 2C:
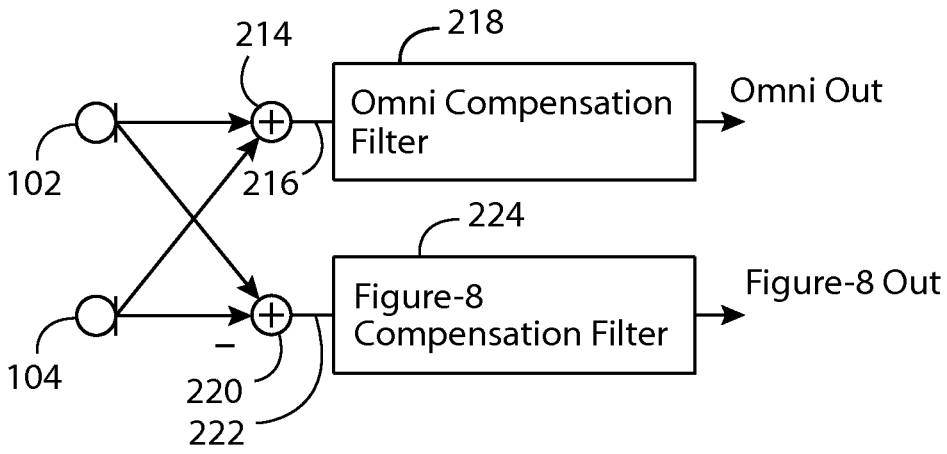
FIG 2C PRIOR ART

FIG. 2C shows a simplified capsule compensation topology for back-to-back cardioid microphones in the prior art. The output signal from the front capsule 102 and the output signal from the rear capsule 104 are summed 214 and a first summed signal 216 that results has an omni-directional polar pattern. A first compensation filter 218, labeled "Omni Compensation Filter," filters the first summed signal 216, resulting in an omni-directional polar pattern output with compensation. The inverse of the output signal from the rear capsule 104 is summed 220 with the output signal from the front capsule 102. The second summed signal 222 that results has a figure-eight polar pattern. A second compensation filter 224, labeled "Figure-8 Compensation Filter", filters the second summed signal 222. The resulting output is a figure-eight polar pattern output with compensation that attempts to overcome irregularities in the microphone capsule frequency response.

Figure 2D:
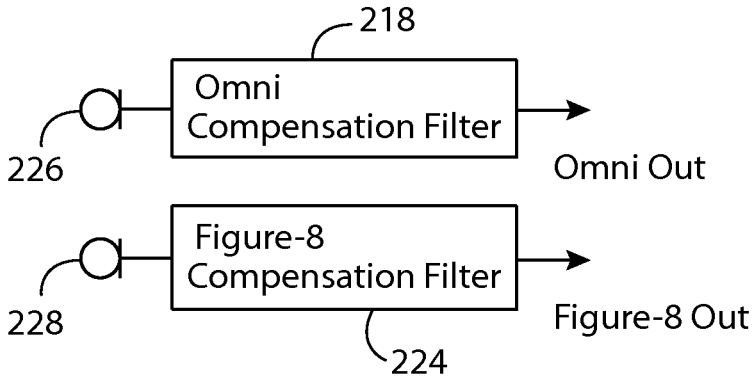
FIG 2D PRIOR ART

FIG. 2D shows a topology for capsule compensation for a pair of coincident microphones capsules where one capsule has an omni-directional polar pattern and the other capsule has figure-eight polar pattern, in the prior art. The first compensation filter 218 filters the output signal from an omni-directional capsule 226, resulting in an output that represents an attempt to compensate for irregularities in the omni-directional capsule 226 frequency response. Similarly, the second compensation filter 224 filters the output from the figure-eight capsule 228, resulting in an output that represents an attempt to compensate for irregularities in the figure-eight capsule 228.

The compensation topologies of FIG. 2A-2D attempt to compensate in various ways for deficiencies in microphone capsule on-axis frequency response. These compensation topologies do not allow each polar pattern to be individually and independently optimized, and in fact, can inadvertently make the off-axis frequency response less ideal than what is possible at some polar pattern settings.

Figure 3:
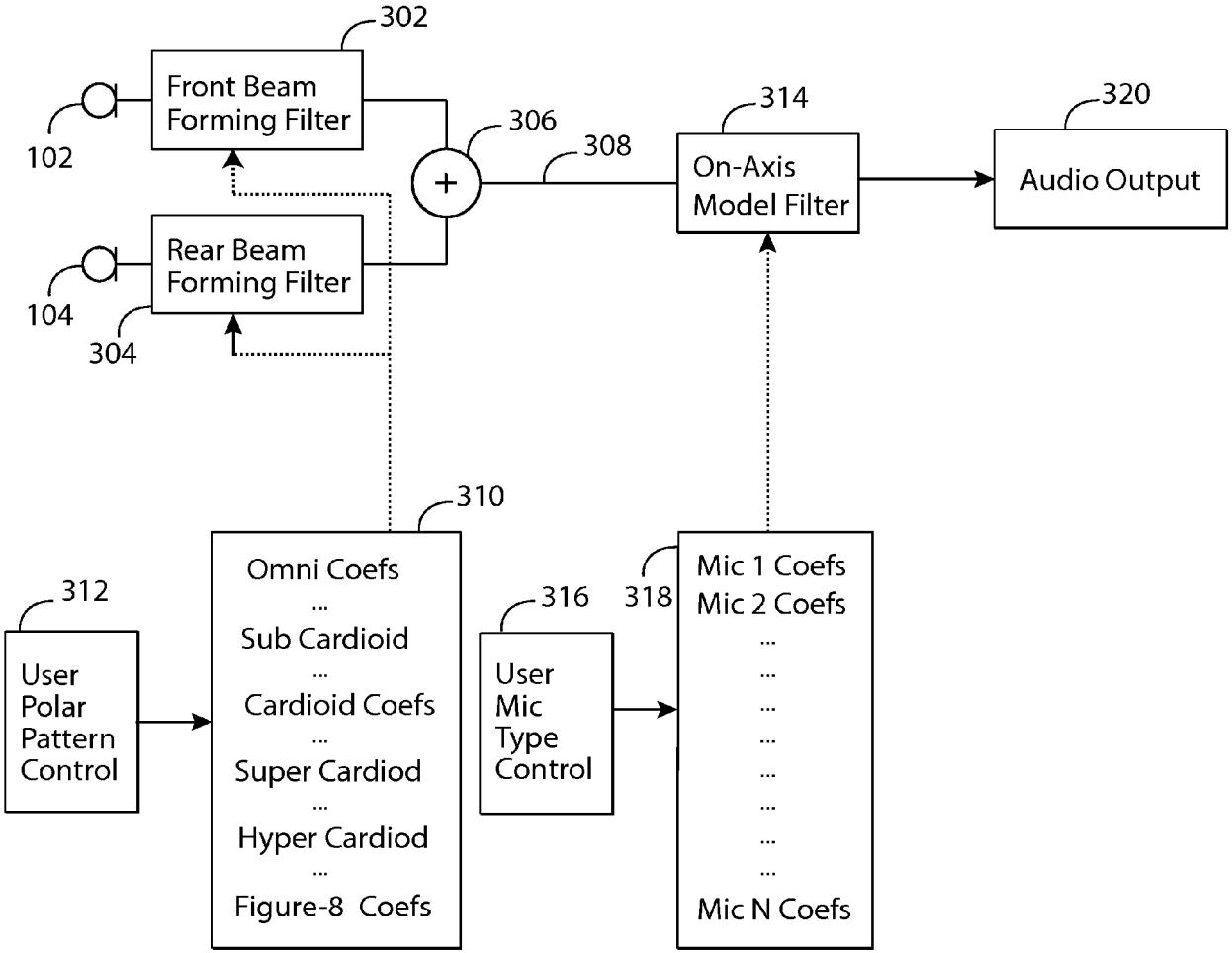
FIG. 3 shows a system and method capable of producing idealized polar patterns and user selectable microphone models.

FIG. 3 shows a system and method capable of producing idealized polar patterns and user selectable microphone models. Illustrated are two cardioid-pattern microphone capsules placed back-to-back forming a front capsule 102 and a rear capsule 104. A first beamforming filter 302, labeled "Front Beamforming Filter", filters the front capsule 102 signal and a second beamforming filter 304, labeled "Rear Beamforming Filter", filters the rear capsule 104 signal. The resultant signals are summed 306 together to produce an output with an idealized polar pattern 308. A table of idealized microphone polar pattern coefficients 310 adjusts coefficients of the first beamforming filter 302 and the second beamforming filter 304. The lookup table includes coefficients for idealized polar patterns, for example, idealized omni-directional, sub-cardioid, cardioid, super cardioid, hyper-cardioid, or figure-eight. A user can select the desired polar pattern via a user polar pattern control 312. The polar panel control can be a physical control such as a knob or series of buttons or can be a virtual control on a graphical user interface. The selected polar pattern via the user polar pattern control 312 determines which coefficients the table of idealized microphone polar pattern coefficients 310 sends to the first beamforming filter 302 and second beamforming filter 304.

With a two capsule microphone, for example, front capsule 102 and rear capsule 104, the frequency dependent polar response can be matched in at least two polar locations on the horizontal plane, because there are two degrees of freedom using beamforming. Due to axial symmetry it is possible to match four locations on the horizontal plane. By designing the physical microphone to resemble the microphone being modeled the response can match additional locations.

The first beamforming filter 302 and the second beamforming filter 304, as well as other beamforming filters described within this disclosure can be implemented using optimization techniques such as least squares, minimax, or genetic algorithms. The optimization process can ensure that the on-axis response is equal to the desired on-axis modeled microphone response, and the off-axis response is optimized to be as close as possible to the desired ideal polar response. For minimax optimization, the maximum error in any one particular direction is minimized. For least squares optimization, then "close as possible" means minimizing the Euclidean distance between the desired and actual complex frequency dependent polar response.

For example, least squares can be implemented with the formula:

$$H=[C^TC+BI]^{-1}C^TA \quad (1)$$

where:

H=matrix of beamforming filters;

A=desired response at multiple angles of incidence;

C=measured response of microphone capsules at multiple angles of incidence;

B=regularization parameter to limit beamforming filter gain within reasonable bounds; and I=identity matrix.

All variables are matrices, so that the optimization can take into account any number of capsules and angle of incidence measurements. The computation can be performed either in the time domain or the frequency domain. C is the matrix of anechoic frequency response measurements at multiple angles of incidence of the actual microphone capsules.

By using multiple sets of coefficients for each user selectable polar pattern as shown in FIG. 3, it is possible to independently optimize each polar pattern to produce the psychoacoustically best result. For example, a figure-eight polar pattern has a "null" in the polar response at 90 degrees off-axis, which being at a low level is subjectively less audible than portions of the polar response that are at a higher level. Therefore the optimizer can give less weight to that portion of the polar response and give more weight to other portions. As another example, an ideal cardioid pattern has a "null" at 180 degrees off-axis, so that portion of the polar response, although important, can be weighted less. For an omni pattern all directions might be weighted equally, or favor may be given to the on-axis direction which usually picks up the most sound because typically the microphone is pointed at the primary source. The prior art shown in FIG. 1 uses a single set of filters and adjusts the polar pattern with a "k" coefficient, which means that each polar pattern cannot be independently optimized, so filter coefficients that are a compromise between all polar patterns must be used.

Due to the proximity-effect the resulting H filters will be calibrated to a single distance, of the source with respect to the front capsule 102 and the rear capsule 104, corresponding to the distance that the measurements were made for the C matrix. For example, if the frequency response measurements for C were measured at approximately 1 meter (approximately 3.3 feet) from the source radiator (typically a loudspeaker) then the beamforming will be calibrated to approximately 1 meter (approximately 3.3 feet) and the frequency and polar responses will be most accurate at that distance. The first beamforming filter 302 and the second beamforming filter 304 can be calibrated to a far-field response, which assumes plane wave sources or infinite distance from a point source. For example, calibration measurement distance of approximately 30 meters (approximately 98 feet), or similar large distance, can give a response that approximates true far-field measurements within the audible frequency range. Other embodiments include proximity correction, so that the frequency and/or polar response will be correct for a range of distances.

The A matrix includes the ideal frequency response at the same angles of incidence used in the C matrix. If the matrix includes one scalar gain value for each angle of incidence then resulting frequency response will be optimized to be as close as possible, in a least squares sense, to a flat linear phase frequency response. By choosing gain values based on a formula for first order spherical harmonics various idealized polar patterns can be generated. For example, Gain=(1−k)+k·cos(x). Where x is the angle of incidence and k is the polar pattern coefficient. Ideal omni-directional pattern corresponds to k=0, cardioid to k=0.5, and figure-eight to k=1. Sub-cardioid, super-cardioid and hyper-cardioid correspond to various in between values. No explicit capsule frequency/polar response compensation is needed because that is automatically incorporated into the beamforming filters.

An on-axis microphone model filter 314 receives the idealized polar pattern 308. Using a user microphone type selection control 316, the user can emulate a classic microphone such as a Neumann U87, Neumann M50, Sony C800G, AKG414, a Shure SM57, or choose a system defined frequency response pattern. This list is merely exemplary and not meant to be exhaustive or limiting; other microphone emulation is possible, and the user can optionally select no emulation to obtain a flat frequency response. The user microphone type selection control 316 can be a physical control such as knobs or buttons, or can be a virtual control on a graphical user interface. The user microphone type selection control 316 output signal is utilized by a table of on-axis microphone model coefficients 318. Based on the setting of the user microphone type selection control 316, the table of on-axis microphone model coefficients 318 will send a set of coefficients to the on-axis microphone model filter 314. The resulting audio output 320 has both an idealized on-axis and off-axis polar pattern and has an on-axis frequency response that emulates a microphone chosen by the user.

The coefficients for the on-axis microphone model filter 314 are created by taking anechoic on-axis measurements of the desired microphone impulse response. If the microphone offers selectable polar patterns or other options, the measurements may be done for each combination of settings. The distance from the source should be calibrated to some specific distance that is the same as the C matrix measurements. As with the C matrix, the measurements can be calibrated to a far-field response, by using a suitably far distance from the source. If using an FIR filter implementation the impulse response can be converted directly to filter coefficients. For an IIR filter implementation some filter design method is used, such as Prony or Steiglitz-McBride algorithms, to match the filter coefficients to the impulse response.

Even though the coefficients are stored as discrete sets with a large number of sets and interpolation adjustment can be made continuously. This has an advantage over the approach of FIG. 1, of blending omni-directional polar pattern with figure-eight polar pattern in various proportions to produce a range of polar patterns. The approach of FIG. 1 does not allow for different optimization tradeoffs to be made for each polar setting.

Figure 4:
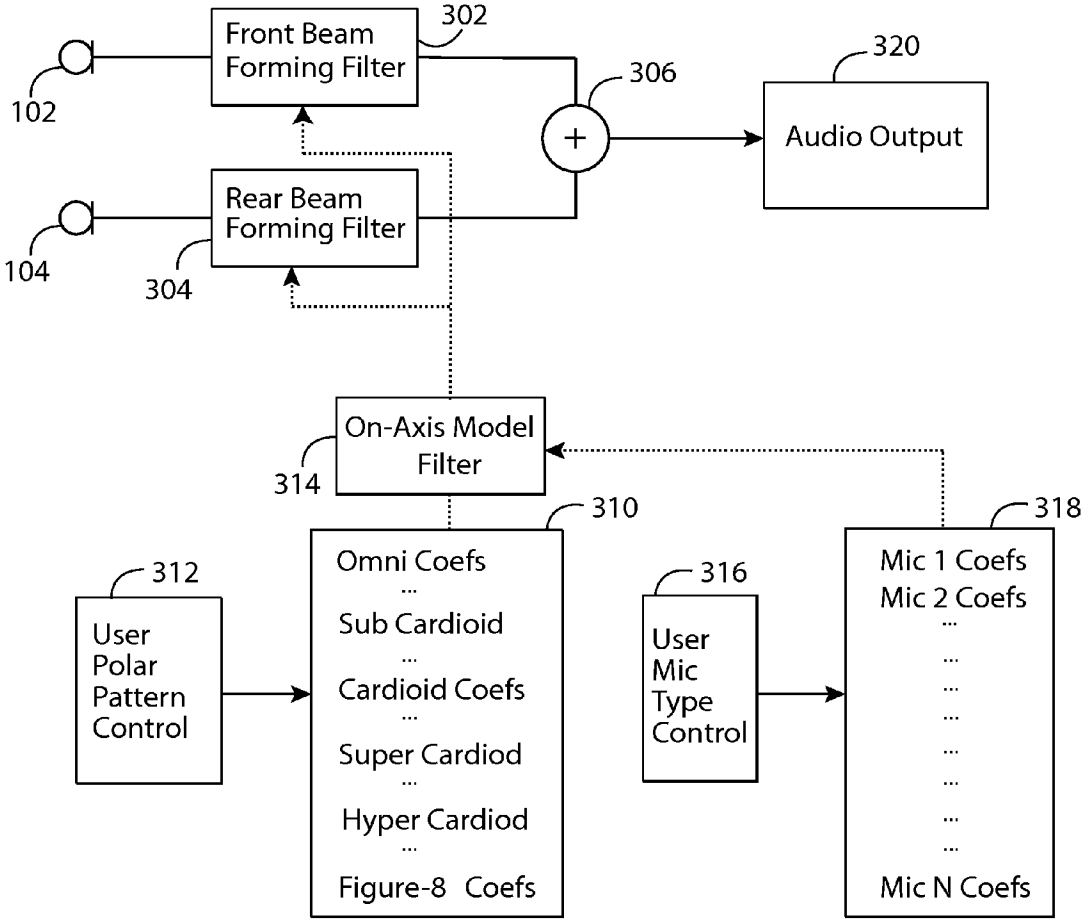
FIG. 4 shows a system and method capable of producing idealized polar patterns and user selectable microphone models where the beamforming filters and on-axis filter coefficients are convolved.

In the system and method of FIG. 3 the on-axis microphone model filter 314 follows the first beamforming filter 302 and the second beamforming filter 304 in series. Because of this, the on-axis microphone model filter 314 can color the off-axis response polar response that is part of the idealized polar pattern 308. FIG. 4 shows a system and method capable of producing idealized polar patterns and user selectable microphone models where the first beamforming filter 302, the second beamforming filter 304, and the on-axis filters are convolved. The filters can be FIR filters or other filter algorithms suitable for convolution. In this arrangement, the amount of computation needed can potentially be reduced, because the responses of three filters are combined into two filters.

Referring to FIG. 4, two cardioid-pattern microphone capsules placed back to back forming a front capsule 102 and a rear capsule 104 as described in FIG. 3. The first beamforming filter 302 and the second beamforming filter 304 are each convolved with the on-axis microphone model filter 314 based on a combination of values from the table of idealized microphone polar pattern coefficients 310 and the table of on-axis microphone model coefficients 318. The user polar pattern control 312 determines the table of idealized microphone polar pattern coefficient's values. The user microphone type selection control 316 selects the coefficient values of the table of on-axis microphone model coefficients 318. The coefficient generation in FIG. 4 is identical to that of FIG. 3 expect for the convolution step to combine the coefficients into one filter.

The resultant convolution of the first beamforming filter 302 and on-axis microphone model filter 314 processes the signal from the front capsule 102. The resultant convolution of the second beamforming filter 304 and on-axis microphone model filter 314 processes the signal from the rear capsule 104. The resultant signals are summed 306 together to produce an audio output 320 with both a modeled microphone and an idealized polar pattern.

Figure 5:
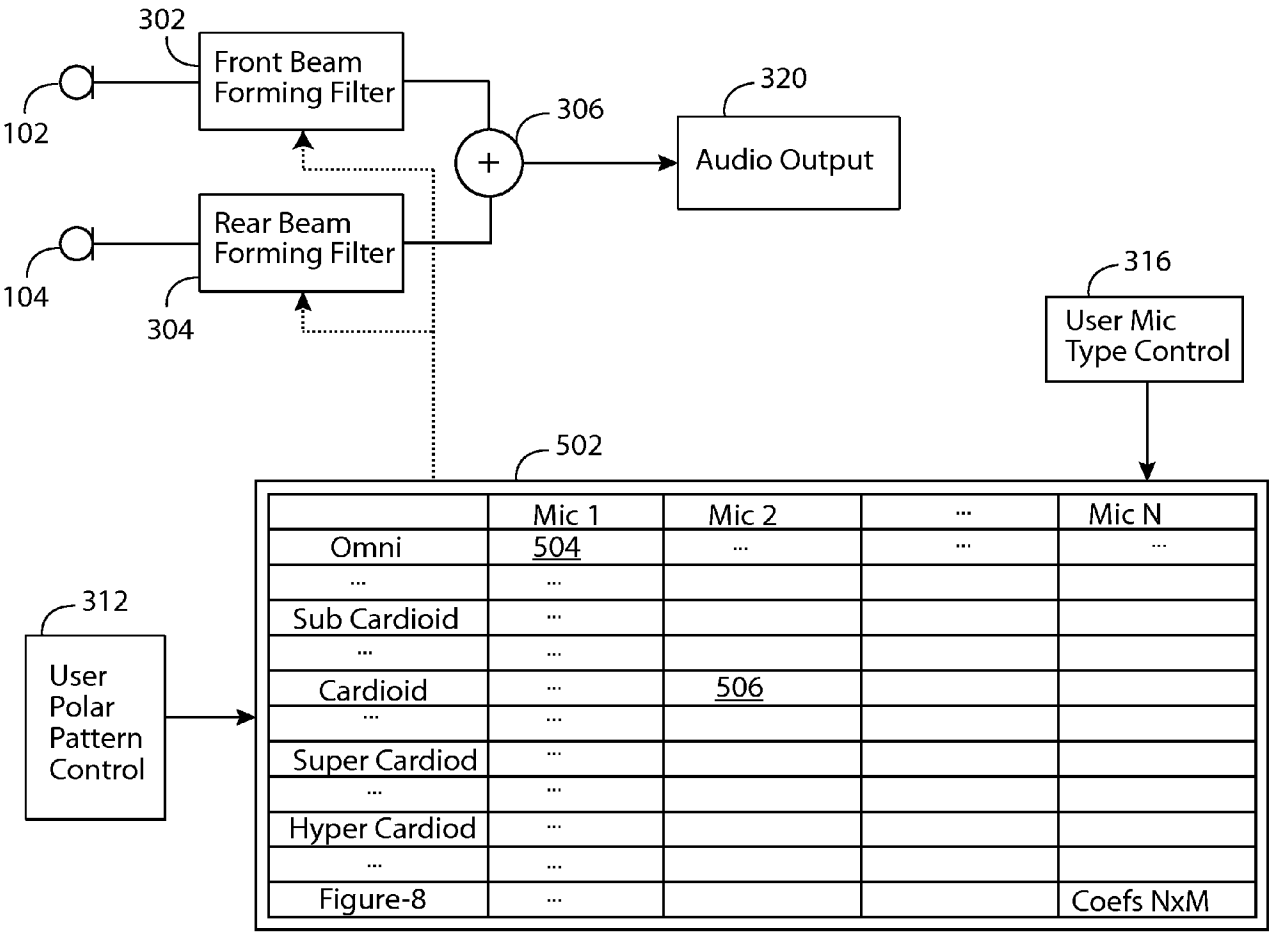
FIG. 5 shows a system and method capable of producing idealized polar patterns and user selectable microphone models utilizing a two-dimensional lookup table where both the idealized polar pattern response and the on-axis microphone modeling are achieved by beamforming filters.

FIG. 5 shows a system and method capable of producing idealized polar patterns and user selectable microphone models utilizing a two-dimensional lookup table 502 where both the idealized polar pattern response and the on-axis microphone modeling achieved by beamforming filters. The off-axis portion of the idealized polar pattern response can avoid some or all of the coloration from the on-axis microphone modeling.

Referring to FIG. 5, illustrated are two cardioid-pattern microphone capsules placed back-to-back forming a front capsule 102 and a rear capsule 104 as described in FIG. 3. The first beamforming filter 302 filters the front capsule 102 signal and the second beamforming filter 304 filters the rear capsule 104 signal. The resultant signals are summed 306 together to produce the resulting signal to the audio output 320 that is a combination of an idealized on and off-axis polar pattern with an on-axis frequency response modified to emulate a user selected microphone model.

A two-dimensional lookup table 502 adjusts coefficients of the first beamforming filter 302 and the second beamforming filter 304. The lookup table includes a matrix of coefficients with idealized polar patterns on one first axis and microphone models on a second axis. In the illustrated table the user polar pattern control 312 determines which row is selected. The user microphone type selection control 316 determines the column is selected. The nexus of the row selected and the column selected determines the coefficient values sent to the first beamforming filter 302 and the second beamforming filter 304.

For example, if the user selects an omni-directional polar pattern with the user polar pattern control 312 and "Mic-1" with the user microphone type selection control 316, then the set of coefficients utilized by the first beamforming filter 302 and the second beamforming filter 304 will be selected from a first cell 504. As a second example, if the user selects a cardioid polar pattern with the user polar pattern control 312 and "Mic-2" with the user microphone type selection control 316, then the set of coefficients utilized by the first beamforming filter 302 and the second beamforming filter 304 will be selected from a second cell 506. Note, that while in this illustrative example, the rows of the two-dimensional lookup table 502 are determined by the user polar pattern control 312 and the columns by the user microphone type selection control 316, it should be understood by the reader that this is illustrative and other implementations of a two dimensional lookup table are possible.

The coefficients for this method are created by setting up the optimizer to optimize the measured on-axis response simultaneously with idealized flat frequency off-axis response. In the least squares example this is done by setting the A matrix so the column or row corresponding to the on-axis direction contains the response for the desired microphone and the idealized response for the other off-axis directions. This procedure is repeated for every microphone and polar pattern combination, so that the 2D lookup table has an entry in each cell.

Figure 6:
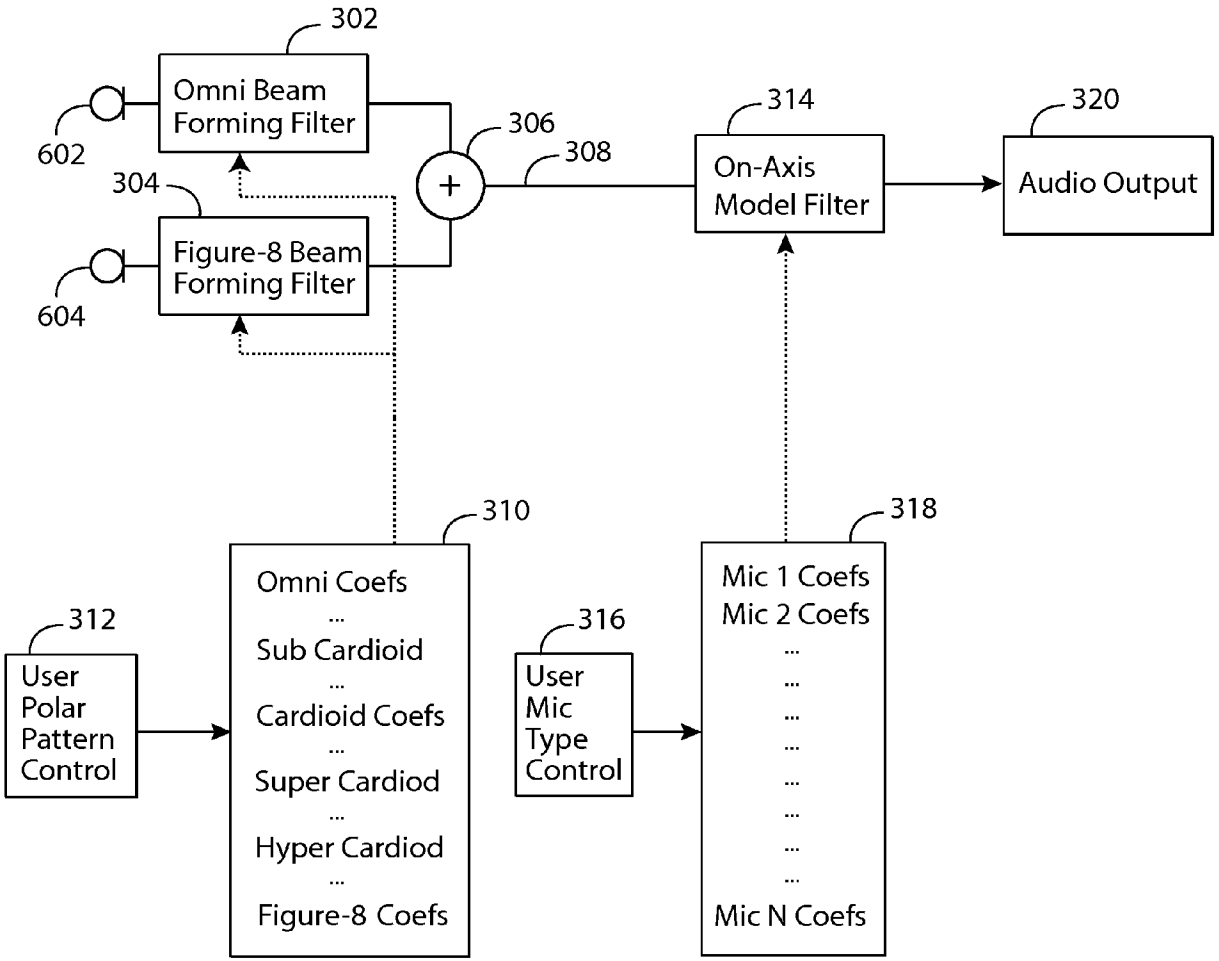
FIG. 6 shows a system and method capable of producing idealized polar patterns and user selectable microphone models utilizing coincident or near-coincident omni-directional and a figure-eight microphone capsules.

FIGS. 3-5 illustrate systems capable of producing idealized polar patterns and user selectable microphone models utilizing back-to-back cardioid pattern microphone capsules. FIG. 6 shows a system and method capable of producing idealized polar patterns and user selectable microphone models utilizing coincident omni-directional and a figure-eight microphone capsules. Referring to FIG. 6, illustrated is an omni-directional pattern microphone capsule 602 placed coincident with a figure-eight pattern microphone capsule 604. The first beamforming filter 302, labeled here as "Omni Beamforming Filter", filters the omni-directional pattern microphone capsule 602 signal and the second beamforming filter 304, labeled as "Figure-8 Beamforming Filter", filters the figure-eight pattern microphone capsule 604 signal. The resultant signals are summed 306 together to produce the idealized polar pattern 308. The table of idealized microphone polar pattern coefficients 310 adjusts coefficients of the first beamforming filter 302 and the second beamforming filter 304. The lookup table includes coefficients for idealized polar patterns as previously described, for example, idealized omni-directional, sub-cardioid, cardioid, super-cardioid, hyper-cardioid, or figure-eight patterns, as previously described. The selected polar pattern via the user polar pattern control 312 determines which coefficients the table of idealized microphone polar pattern coefficients 310 sends to the first beamforming filter 302 and second beamforming filter 304.

The procedure for calculating the omni-directional/figure-eight beamforming filters is essentially the same as the other methods, but in this case the C matrix is contains measurements of the omni-directional and figure-eight polar pattern capsules instead of cardioid polar pattern capsules. The optimizer, such as least squares, will then generate coefficients for this capsule configuration.

The on-axis microphone model filter 314 receives the idealized polar pattern 308 that has been compensated for both on and off-axis frequency response. The user can emulate a classic microphone such as a Neumann U87, Neumann M50, Sony C800G, AKG414, a Shure SM57, or choose a system defined frequency response pattern using the user microphone type selection control 316. As previously described, this list of microphones is merely exemplary and not meant to be exhaustive or limiting; other microphone emulation is possible, and the user can optionally select no emulation to obtain a flat frequency response. Based on the setting of the user microphone type selection control 316, the table of on-axis microphone model coefficients 318 will send a set of coefficients to the on-axis microphone model filter 314. The audio output 320 that results has an idealized on-axis and off-axis polar pattern with an on-axis frequency response that has been adjusted from the ideal to emulate a user selected microphone model.

Figure 7:
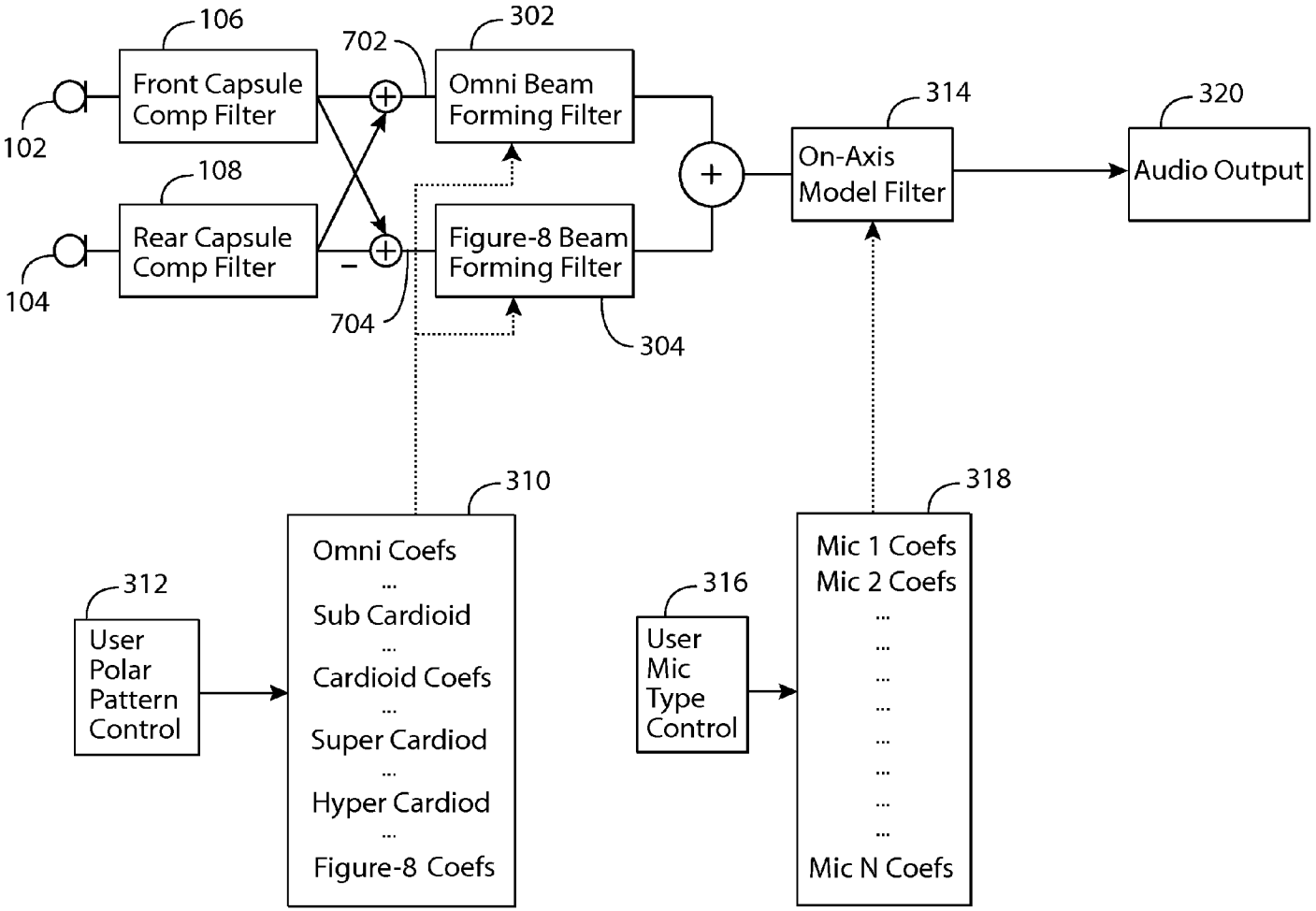
FIG. 7 shows a system and method capable of producing idealized polar patterns and user selectable microphone models with beaming forming filter and on-axis filter topology as in FIG. 6 but utilizing coincident or near-coincident back-to-back cardioid capsules and compensation scheme of FIG. 2A.

FIG. 7 shows a system and method capable of producing idealized polar patterns and user selectable microphone models with beaming forming filter and on-axis filter topology as in FIG. 6 but utilizing back-to-back cardioid capsules and compensation scheme of FIG. 2A. Referring to FIG. 7, the output from the front capsule 102 and a rear capsule 104 are filtered and summed using the first compensation filter 106 and the second compensation filter 108 to form an omni-directional polar pattern 702 and a figure-eight polar pattern 704.

The omni-directional polar pattern 702 and figure-eight polar pattern 704 are processed, in the manner described for FIG. 6, utilizing the first beamforming filter 302, the second beamforming filter 304, table of idealized microphone polar pattern coefficients 310, user polar pattern control 312, the on-axis microphone model filter 314, the user microphone type selection control 316, and the table of on-axis microphone model coefficients 318, to produce the audio output 320 with an idealized on and off-axis polar pattern with an on-axis frequency response that has been adjusted to emulate the user selected microphone model.

Figure 8:
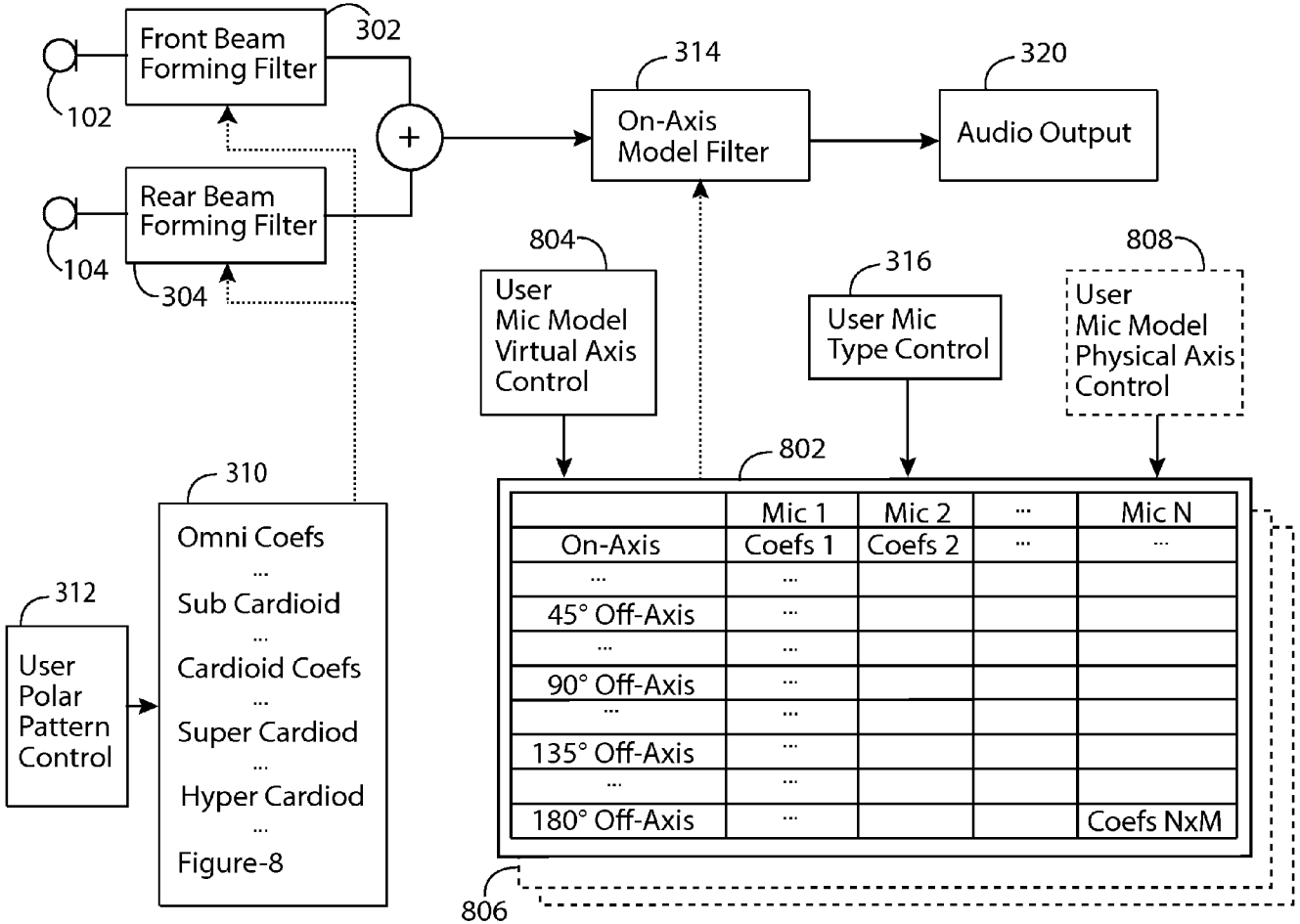
FIG. 8 shows a system and method capable of producing idealized polar patterns, user selectable microphone models, and user selectable virtual rotation of a microphone.

In a sound recording environment, there are occasions where a recording engineer will physically turn a microphone off-axis with respect to the sound source in order to affect the tone quality of the sound. This can result in high frequency roll-off or other frequency response changes that are not easily achieved with standard equalizers, and which may complement particular instruments or voices. FIG. 8 shows a system and method for producing user selectable on-axis microphone models combined with idealized polar responses in combination with the modeling of rotating the microphone off-axis from the sound source. In this case the on-axis model filter becomes an off-axis model filter.

Alternatively in a live concert situation a vocalist often holds the microphone in an off-axis position so that the microphone can be held comfortably and so it does not substantially block the audience's view of the vocalist's face. In this scenario the vocalist may want the output of the microphone to sound as if it is being used on-axis even though practical considerations preclude that. With an appropriate coefficient set applied to the two-dimensional lookup table 802 of FIG. 8 it becomes possible to model an on-axis response even when the physical microphone is positioned off-axis.

In FIG. 8, the front capsule 102, the rear capsule 104, first beamforming filter 302, second beamforming filter 304, on-axis microphone model filter 314, audio output 320, user polar pattern control 312 and idealized microphone polar pattern coefficients 310 are configured as previously described for FIG. 3. The two-dimensional lookup table 802 includes coefficient sets that simulate various microphone model types, as previously described, and coefficients that simulate rotating each of those models types with respect to the sound source. The two-dimensional lookup table 802 determines the coefficient sets sent to the on-axis microphone model filter 314. A combination of the user microphone type selection control 316 and a user microphone model axis control 806 selects the coefficient sets of the two-dimensional lookup table 802.

As an example, if the user selects that the microphone will be rotated 45 degrees with respect to the sound source with the user microphone model virtual axis control 804, then coefficients for a 45-degree off-axis response of the microphone model selected by the user microphone type selection control 316 will be applied to the on-axis microphone model filter 314. This is somewhat different from actually rotating a microphone by 45 degrees. When you physically rotate a microphone, the polar pattern also rotates a corresponding amount. In the system and method of FIG. 8, the polar pattern remains constant; only the tonality of the microphone is changed and can be helpful in certain recording situations.

By expanding the two-dimensional lookup table 802 of FIG. 8 to be three dimensional where the axes consist of microphone type, physical axis rotation, and virtual axis rotation it is possible for the user to independently set the physical and virtual axis rotations. This is represented in FIG. 8 by stacked tables 806 shown in broken lines; each table representing a different virtual axis of rotation. The physical axis rotation control is represented by a user microphone model physical axis control 808 shown in a broken line outline. For example, if the physical microphone is positioned 60 degrees off-axis and the user would like the response to match a microphone that is 15 degrees off-axis, then the user would set the user microphone model physical axis control 808 to 60 degrees and the user microphone model virtual axis control 804 to 15 degrees.

With certain capsule configurations that have three or more capsules it is also possible to virtually rotate the polar pattern, not just shift the on-axis tonality, by making corresponding adjustments to the beamforming filters. In this case the polar pattern rotation can be adjusted independently of the microphone model axis rotation. This feature can be readily incorporated in the disclosed methods and systems.

Figure 9:
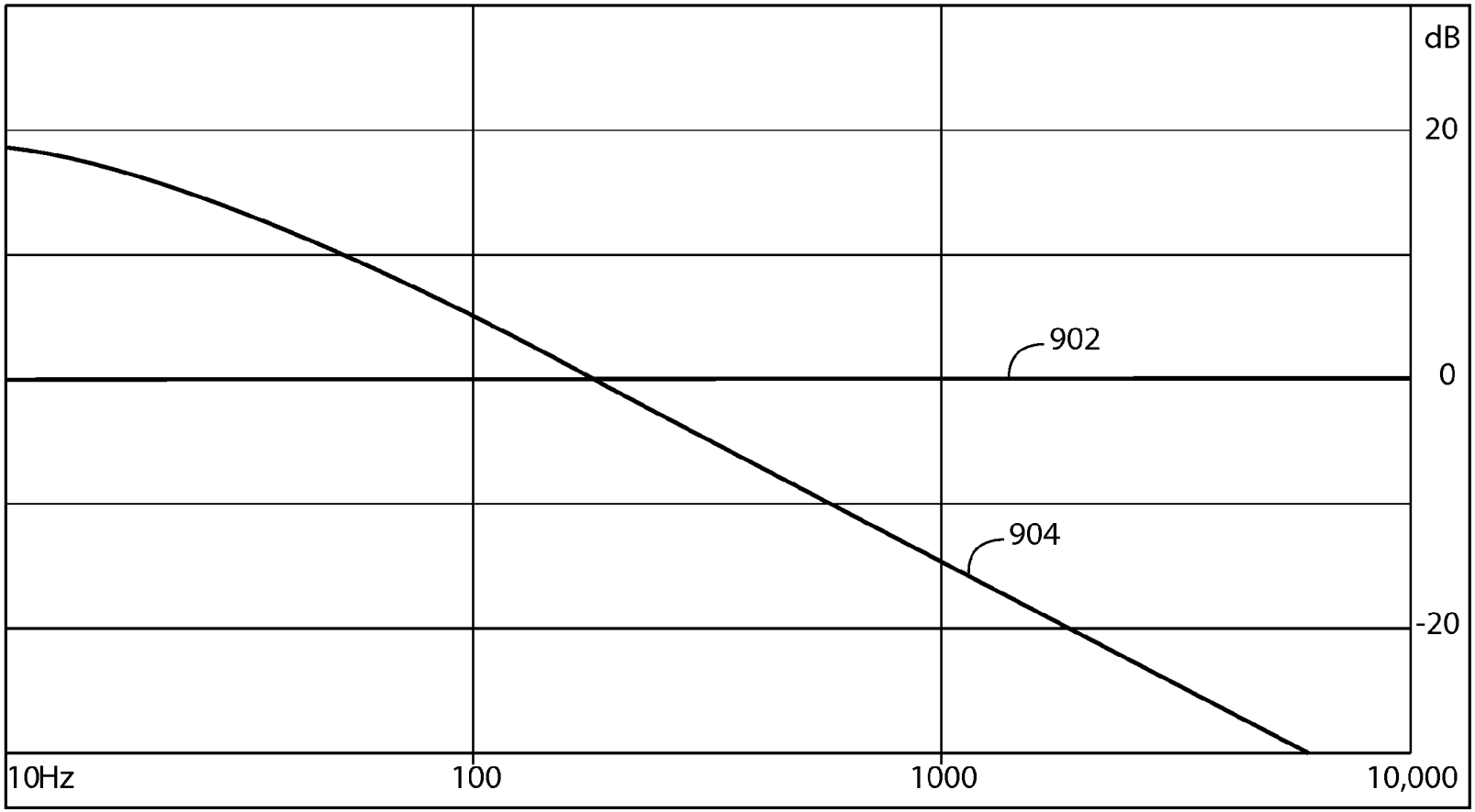
FIG. 9 shows the phase gradient component and the inverse square law component of a theoretically ideal figure-eight microphone.

The systems and methods capable of producing idealized polar patterns and user selectable microphone models where the on-axis microphone modeling described thus far do not compensate for proximity-effect. The proximity-effect causes distance dependent low frequency response changes in the velocity component, or figure-eight polar pattern component of a microphone. FIG. 9 shows the phase gradient (proportional to the difference in phase between the front and rear of the diaphragm) and inverse square law components (proportional to the difference in pressure between the front and rear of the diaphragm) of a theoretically ideal figure-eight microphone polar pattern. A first plot 902 shows the on-axis frequency response with microphone diaphragm damping applied. A second plot 904 shows the inverse-square-law component of the microphone output. This inverse-square-law component is what causes proximity-effect. As sound travels through air, total energy is conserved based on the inverse square law. For example, sound energy at approximately 2 meters (approximately 6.6 feet) from a point source is one quarter that of the sound energy at approximately 1 meter (approximately 3.3 feet). Directional microphones "sense" the sound at more than one location to discriminate the direction of arrival, but the inverse-square-law means the sound intensity will be slightly different at each pickup location resulting in a larger output from the microphone.

Figure 10:
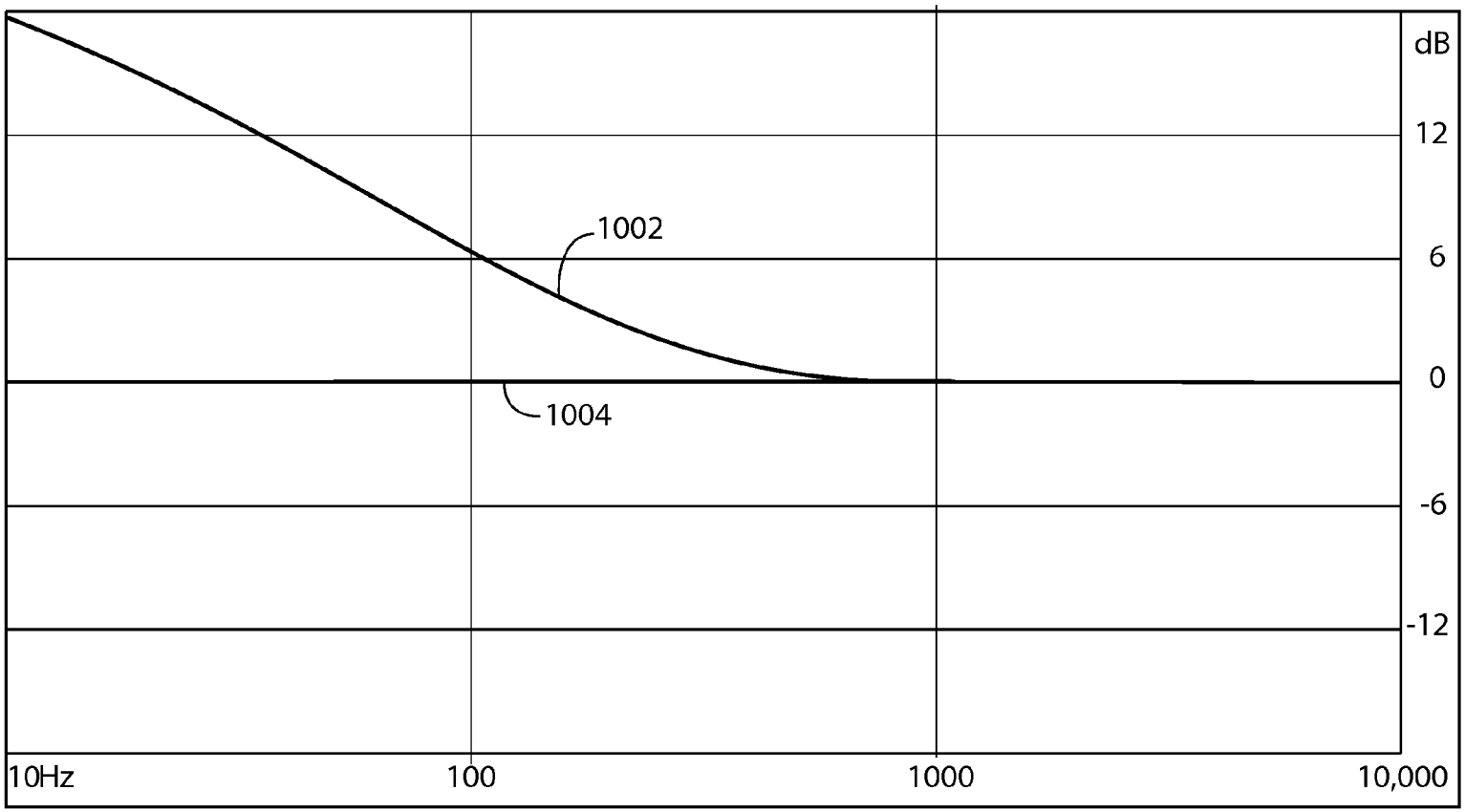
FIG. 10 shows a graph illustrating the total output frequency response of the microphone of FIG. 9 both with and without proximity effect.

FIG. 10 shows a graph illustrating the total output frequency response of the microphone of FIG. 9. This is the sum of the of the phase gradient component with the inverse-square-law component. The low frequency response is a function of distance. When the microphone is placed more closely to a source the inverse-square-law component will increase in level relative to the phase gradient component, resulting in a larger low frequency boost. Plot 1002 shows the resultant low frequency boost when the sound source is within close proximity to the microphone. Plot 1004 shows an idealized flat on-axis response at a relatively far distance.

The proximity-effect also distorts the polar pattern at low frequency. For example, a cardioid microphone response is made up of half omni plus half figure-eight. This produces at null in the polar response at 180 degrees off-axis. But when the inverse-square-law component is added, the figure-eight response becomes greater than omni at low frequencies. If assuming ideal microphone capsules, the polar response will move towards figure-eight at low frequencies.

FIGS. 11A-11B shows a system and method capable of producing idealized polar patterns and user selectable microphone models with proximity-effect compensation. A letter with a circle indicates a common signal node between the two FIGS. 11A and 11B. Illustrated in FIGS. 11A-11B is an arrangement with proximity filters to independently compensate for the on-axis frequency response and the off-axis polar response. In a similar manner as previously described, two cardioid-pattern microphone capsules placed back-to-back to form the front capsule 102 and the rear capsule 104. A first compensation filter 106 processes the output signal of the front capsule 102 and a second compensation filter 108 processes the output signal of the rear capsule 104.

The output of the first compensation filter 106 and the output of the second compensation filter 108 are summed 110 to form an omni-directional polar pattern signal 112. The outputs of the first compensation filter 106 and the inverse of the output of the second compensation filter 108 are summed 114 to form a figure-eight polar pattern signal 116. A third compensation filter 118 corrects frequency response and polar pattern non-idealities from omni-directional polar pattern signal 112. A fourth compensation filter 120 corrects frequency response and polar pattern non-idealities from the figure-eight polar pattern signal 116. The resulting outputs of the compensation filters have a substantially flat on-axis response so that changing the polar pattern does not significantly affect the on-axis response.

The first linear gain stage 122 with a gain of 1−k receives the signal from the output of the third compensation filter 118. The second linear gain stage 124 with a gain of k receives the signal form the output of the fourth compensation filter 120. The gain of the first linear gain stage 122 and the second linear gain stage 124 is determined by the value of k mapped from the polar pattern lookup table 126. The signal path for a node marked "B," designates the polar pattern lookup table 126 between FIGS. 11A and 11B. The lookup table selects the value of k based on a user polar pattern control 128. The user polar pattern control 128 can include a physical control such as a knob or switches or can be a virtual control on a graphical user interface.

An inverse off-axis proximity filter 1102 processes the output of the second linear gain stage 124. The inverse proximity filter is used to flatten the change in frequency response due to proximity-effect. The inverse off-axis proximity filter 1102 is applied to the figure-eight, or velocity component, so that the polar response is idealized at low frequencies for a particular distance.

An off-axis proximity filter lookup table 1104 determines the coefficient value of the inverse off-axis proximity filter 1102 based on a distance value selected by the user using a user off-axis distance control 1106.

The "off-axis proximity filter" is the same as in all other cases. For the 1st order case, for example:

$$H(z)=(B0+B1\cdot z-1)/(1+A1\cdot z-1) \quad (2)$$

$$A1=\sin(kPi/4-w/2)/\sin(kPi/4+w/2) \quad (3)$$

$$A1=\sin(kPi/4-x/2)/\sin(kPi/4+w/2) \quad (4)$$

$$B0=0.5*(G_f+1.0-A1*(G_f-1.0)) \quad (5)$$

$$B1=0.5*(G_f-1.0-A1*(G_f+1.0)) \quad (6)$$

Where:

$G_f$=Shelf Gain;

w/2=(pi*Fc/Fs);

kPi/4=pi*0.25;

Fc=+/−3 dB cutoff frequency; and

Fs=Sample Rate.

The inverse proximity filter can be calculated in the same manner, but with the denominator and numerator inverted. For example, in equation (7):

$$H(z)=(1+A1\cdot z-1)/(B0+B1\cdot z-1) \quad (7)$$

The user off-axis distance control 1106 can be a physical control, for example, a knob or push buttons, or can be a virtual control such as a knob, slider or buttons on a graphical user interface. The off-axis proximity filter lookup table 1104 includes coefficient values for a filter that model the inverse square law at various distances. The inverse-square-law filter coefficient values are based on measured proximity-effect of the microphone at various distances. For first order gradient microphones, such as those with a figure-eight polar pattern, the inverse square law component can be approximately modeled as first order 6 dB per octave (20 dB/decade) low pass IIR filter. More accurate results might be obtained with a second or higher order filter.

The −3 dB cutoff frequency of the first order lowpass filter can be set to 20 Hz or the lowest audible frequency. Setting the filter any lower will unnecessarily increase subsonic energy. The lowpass filter will be mixed in with the directly signal at level that is set by the distance table. The larger the gain of the lowpass filter the more proximity-effect will be modeled. At a distance setting of infinity the lowpass gain coefficient will be zero, and will increase as the distance is reduced. For example, at a distance of two meters the corresponding gain might be 1.0. Or at a distance of 10 centimeters (3.9 inches) the gain might be 4.0. The gain values for each distance can be derived empirically or using an optimization routine of measurements at various distances.

The output of the first linear gain stage 122 and the inverse off-axis proximity filter 1102 are summed 1108. In a similar manner as previously described, depending on the value of k, a summed signal 1110 that results can have an omni-directional, cardioid, figure-eight, or other polar response patterns.

If the user selects figure-eight polar pattern using the user polar pattern control 128, then the polar pattern lookup table 126 selects k=1. The first linear gain stage 122 would have a gain of 0 and the second linear gain stage 124 would have a gain of 1. The summed signal 1110 that results would have an output entirely from the inverse off-axis proximity filter 1102, and therefore a figure-eight polar pattern.

If the user selects a cardioid polar pattern using the user polar pattern control 128, then the polar pattern lookup table 126 selects k=0.5. The first linear gain stage 122 would have a gain of 0.5 and the second linear gain stage 124 would have a gain of 0.5. The summed signal 1110 that results would have an output with equal contributions from the first linear gain stage 122 and the inverse off-axis proximity filter 1102. The summed signal 1110 that results is a cardioid polar pattern. The summed signal 1110 is labeled "A" and designates a common signal path between FIGS. 11A and 11B.

In the next stage, a proximity compensation filter 1136 is applied to the summed signal 1110. The proximity compensation filter 1136 sums and convolves an on-axis proximity filter and an inverse off-axis proximity filter with the input 1120 in a proportion based on the value of k. The result is then inverted, so that the on-axis frequency response is flat at a user specified distance. The z-domain equation for the proximity compensation filter 1136 is: H(z)=1/((1−k)+k*(On-Axis Proximity)*(Inverse Off-Axis Proximity)). The on-axis proximity filter 1130 and the proximity compensation filter 1136 is controlled by a user on-axis distance control 1138 via an on-axis proximity filter lookup table 1140. The on-axis proximity filter lookup table 1140 maps filter coefficient values based on the distance value set by the user with the user on-axis distance control 1138. In a similar manner, both the inverse off-axis proximity filter 1102 of the previous stage and the inverse off-axis proximity filter in the proximity compensation filter 1136 are controlled by a user off-axis distance control 1106 via an off-axis proximity filter lookup table 1104. The control signal path from the off-axis proximity filter lookup table 1104 between FIGS. 11A and 11B is indicated by label "C." The off-axis proximity filter lookup table 1104 maps filter coefficient values based on the distance value set by the user with the user off-axis distance control 1106. The on-axis proximity filter lookup table 1140 and the off-axis proximity filter lookup table 1104 include coefficient values for filters that model the inverse square law at various distances. The inverse-square-law filter coefficient values are based on measured proximity-effect of the microphone at various distances. The k values in the proximity compensation filter 1136 are selected by the user polar pattern control 128 from the polar pattern lookup table 126. The control signal path from the polar pattern lookup table 126 to the proximity compensation filter 1136 across FIGS. 11A and 11B is indicated by label "B."

In the next stage, low frequency modeling filters are applied to the proximity compensation filter output 1122 in order to emulate a user selected microphone model, for example a Neumann U87, AKG414, a Shure SM57, or a system generated response. The proximity compensation filter output 1122 is split and processed by an omni-directional low frequency microphone model filter 1126, and a combination of a figure-eight low frequency microphone model filter 1128 and on-axis proximity filter 1130. The outcome of this stage is summed 1132 creating a summed signal 1134.

The procedure to generate coefficients for the on-axis proximity filter 1130 is similar to that of the off-axis proximity filter 1116 except the filters can be controlled independently by the user. Alternatively, a single distance control can control both the on and off-axis proximity. In this case, the combined effect of inverse off-axis proximity filter and the on-axis proximity filter cancel each other out, so the proximity compensation filter 1136 can be removed to reduce processing requirements. It should be noted that for FIGS. 12A-B, discussed later, the proximity compensation filter 1216 can be similarly removed.

A high frequency on-axis microphone model filter 1144 filters the summed signal 1134. The user selects the microphone to be emulated using a user microphone type selection control 316. The user microphone type selection control 316 controls the high frequency on-axis microphone model filter 1144 through a table of high frequency on-axis microphone model coefficients 1148. The user microphone type selection control 316 controls the omni-directional low frequency microphone model filter 1126, and the figure-eight low frequency microphone model filter 1128 through a second microphone model lookup table 1150. The audio output 320 resulting from the high frequency on-axis microphone model filter 1144 is a microphone signal adjusted for a more idealized on and off-axis response, compensated for on and off-axis proximity-effect, with on-axis frequency response adjusted away from ideal to emulate a user selected microphone model.

As shown in the previous section, the on-axis microphone model is split up into a low frequency (LF) portion and a high frequency (HF) portion. The crossover frequency between low and high frequencies should be slightly above the range that the proximity filter has a significant effect. A frequency of 1 kHz is a reasonable choice, but values from about 100 Hz to 2 kHz could be used depending on the microphone model and the proximity filter. The high frequency on-axis microphone model filter 1144 is created by flattening the response of the previously described on-axis model filter below the chosen LF/HF crossover frequency. By flattening the response at low frequencies the high frequency on-axis microphone model filter 1144 will pass through the signal unmodified at those frequencies. This flattening can be done as a pre-processing step, so it doesn't affect the real-time operation. One way of implementing the flattening is to convert the on-axis filter coefficients into the frequency domain and then replace the high frequencies with a response that is flat in both phase and magnitude.

The low frequency on-axis model filters are derived in a similar way, but the high frequencies are flattened and the response is decomposed into the omni-directional low frequency microphone model filter 1126, and the figure-eight low frequency microphone model filter 1128 so that the on-axis proximity filter can be applied to the figure-eight component only. The decomposition can be performed in a number of different ways. One way is to measure the anechoic impulse response of the modeled microphone at 90 degrees off-axis. Because a figure-eight response has a null at 90 degrees off-axis this measurement represents the on-axis omni-directional polar pattern portion of the microphone, because by definition the omni-directional polar pattern component is equal in all directions. This omni-directional polar pattern measurement can then be subtracted from the on-axis measurement to produce an accurate estimate of the figure-eight impulse response. The omni-directional and figure-eight impulse responses are then flattened at high frequencies and converted to FIR or IIR filter coefficients as previously described.

The on-axis proximity filter coefficients are also derived in the same way as previously described. It should be noted that these separate linear filter blocks can in general be combined into a single filter. In part they are described as separate filters for increased clarity. Also, in general the linear filter blocks can be reordered without changing the overall effect of the algorithm.

FIGS. 12A-B shows a system and method capable of producing idealized polar patterns and user selectable microphone models utilizing beamforming filters, an on-axis microphone modeling filter, and proximity-effect correction.

A letter with a circle indicates a common signal node between FIGS. 12A and 12B. Referring to FIGS. 12A-B, the user can select the microphone polar pattern utilizing the user polar pattern control 128, the microphone type to be modeled utilizing the user microphone type selection control 316, as well as set the estimated distance the sound source is from the microphone utilizing a user off-axis distance control 1202 and a user on-axis distance control 1204. In this embodiment, there is user model on-axis distance control 1212 acting independently with a corresponding on-axis distance proximity model filter as part of a proximity compensation filter 1216. For some applications, such as live sound, the microphone must be placed very close to the source so that less gain can used, which reduces the possibility of acoustic feedback (i.e., howling). But the bass boost due to the proximity effect can be too great when the microphone is so close. With an independent on-axis proximity filter for the model a farther distance can be simulated, even though the physical microphone is much closer.

In a similar manner as described for FIG. 3, two cardioid-pattern microphone capsules placed back-to-back form the front capsule 102 and the rear capsule 104 with the first beamforming filter 302 filtering the front capsule 102 signal and the second beamforming filter 304 filtering the rear capsule 104 signal. The table of idealized microphone polar pattern coefficients 310 adjusts coefficients of the first beamforming filter 302 and the second beamforming filter 304. The coefficients are selected from the table of idealized microphone polar pattern coefficients 310 based on the user's selection of the user polar pattern control 128.

A first off-axis proximity filter 1206 processes the resultant signal from the first beamforming filter 302. A second off-axis proximity filter 1208 processes the resultant signal from the second beamforming filter 304. Note that the beamforming filters and the on and off-axis proximity filters are derived in the same way as previously described. The resultant signals from the first off-axis proximity filter 1206 and the second off-axis proximity filter 1208 are summed 1210.

The summed signal 1219, shown as a common path across FIGS. 12A and 12B as node "D", is then processed by proximity compensation filter 1216, which is functionally equivalent to proximity compensation filter 1136 in FIG. 11B. The coefficients of the proximity compensation filter 1216 are set based on the user on-axis distance control 1204 selecting the coefficients from the user on-axis distance coefficients table 1222, the user off-axis distance control 1202 selecting the coefficients from the off-axis distance coefficient table 1214, and the user polar pattern control 128 selecting the coefficients from the polar pattern lookup table 126, in a manner similar to FIG. 11B. The common path across FIGS. 12A and 12B between the off-axis distance coefficient table 1214 and the proximity compensation filter 1216 is indicated by node "E." The common path across FIGS. 12A and 12B between from the polar pattern lookup table 126 and the proximity compensation filter 1216 is indicated by node "F."

In the next stage, a first on-axis proximity LF model filter 1218 processes the resultant output of 1216. The user microphone type selection control 316 is utilized to determine which set of coefficients is selected from the table of low frequency microphone model coefficients 1224. The user model on-axis distance control 1212 determines which coefficients from the table of distance coefficients 1226 are utilized by the on-axis proximity model filter within 1218. As previously stated, this separate on-axis distance control allows the microphone model to have an independent distance setting.

The high frequency on-axis microphone model filter 1144 filters the resultant output of the first on-axis proximity LF model filter 1218. The filter 1144 emulates the high frequency on-axis frequency response characteristics of a modeled microphone selected by a user utilizing the user microphone type selection control 316. The user microphone type selection control 316 determines the coefficients from the table of high frequency on-axis microphone model coefficients 1148 utilized by the high frequency on-axis microphone model filter 1144.

FIG. 13 shows a system and method capable of producing idealized polar patterns and user selectable microphone models with alternative method proximity-effect compensation. In FIG. 13, applying off-axis correction only to high frequencies is utilized to compensate for proximity-effect. This will make the amount of proximity-effect equal to the desired microphone type selected by the user. This has the advantage that the user does not need to enter the on and off-axis source distances, but the downside is that the idealized polar response may not be accurate at low frequencies.

The spacing of the capsule diaphragms can be made similar to the spacing of the front and rear inlets on the modeled directional microphone, so that the amount of proximity effect will match well over a wide range of distances.

In a similar manner as described for FIG. 3, in FIG. 13 two cardioid-pattern microphone capsules placed back-to-back forming the front capsule 102 and the rear capsule 104. A first microphone model filter 1302 processes a portion of the signal from the front capsule 102. A first beamforming filter 302 processes the remaining portion of the signal from the front capsule 102. A second microphone model filter 1304 processes a portion of the signal from the rear capsule 104. A second beamforming filter 304 processes the remaining portion of the signal from the rear capsule 104.

A low frequency crossover filter 1306 processes the resultant summed signal 1308 from the outputs of the first microphone model filter 1302 and the second microphone model filter 1304. A high frequency crossover filter 1310 processes the resultant summed signal 1312 from the outputs of the first beamforming filter 302 and the second beamforming filter 304. A high frequency on-axis microphone model filter 1144 processes the resulting output of the high frequency crossover filter 1310. The audio output 320 results from summing the output of the low frequency crossover filter 1306 and the high frequency on-axis microphone model filter 1144.

A table of high frequency on-axis microphone model coefficients 1148 determines the coefficient values of the high frequency on-axis microphone model filter 1144. A table of low frequency microphone model coefficients 1224 determines the coefficient values of the first microphone model filter 1302 and the second microphone model filter 1304.

The front and rear microphone model coefficients can be derived from the omni-directional low frequency microphone model filter 1126 and the figure-eight low frequency microphone model filter 1128 as shown in FIG. 11B. The coefficients can be converted from omni-directional and figure-eight polar patterns to back-to-back cardioid capsules by summing the omni-directional polar pattern coefficients with the corresponding figure-eight coefficients to produce the first microphone model filter 1302 and by subtracting figure-eight from omni-directional polar pattern signal to produce the second microphone model filter 1304. Additional compensation filtering can be used to compensate for non-idealities of the back-to-back cardioid capsules, as previously described. If compensation is needed, it can be incorporated in the beamforming filters via convolution or other described methods.

Alternatively, least squares, or other optimization techniques, can be employed to generate the front and rear microphone model filters from a set of anechoic measurements of desired microphone at various angles of incidence. If using least squares as previously described, the A matrix will contain the measurements of the desired microphone at various angles of incidence. The C matrix should contain measurements of the back-to-back cardioid capsules at the same angles of incidence. Least squares optimization will then generate filter coefficients H that will best match C with A.

A user microphone type selection control 316 controls both the table of high frequency on-axis microphone model coefficients 1148 and the table of low frequency microphone model coefficients 1224. The on-axis model filter coefficients are determined as stated previously. The table of idealized microphone polar pattern coefficients 310 determines the coefficient values of the first beamforming filter 302 and the second beamforming filter 304. The coefficient values are mapped according to the type of microphone pattern selected by a user polar pattern control 128.

The crossover filters are designed so that the crossover frequency is just above the maximum frequency that the proximity-effect is present. Approximately 1 kHz is a reasonable choice although about 100 Hz to 2 kHz could be appropriate depending on the microphone and amount of proximity-effect. The crossovers should have equal phase shift, so that a straight sum of the low and high frequency crossovers produces a flat magnitude response. Linear phase crossovers could be a good choice, since that won't add any phase distortion. The slope of the crossovers should be steep enough so that the low and high bands don't significantly blend together except near the crossover region.

FIG. 14 shows a system and method capable of producing idealized polar patterns and user selectable microphone models with automatic proximity correction where much of the processing has been moved from real-time audio processing to non-real-time coefficient processing. In a similar manner as described for FIG. 3, in FIG. 14 two cardioid-pattern microphone capsules placed back-to-back forming the front capsule 102 and the rear capsule 104. The first beamforming filter 302 processes the signal from the front capsule 102 and the second beamforming filter 304 processes the signal from the rear capsule 104. The output of the first beamforming filter 302 and the output of the second beamforming filter 304 are summed 1402 to form the audio output 320. The first beamforming filter 302 and the second beamforming filter 304 constitute the real-time processing portion of FIG. 14 as they are the only filters that are in the audio signal path.

The coefficients for the on-axis model filter, high and low crossover filters, and the idealized polar response beamforming filters can be derived in a similar manner to the previously described embodiments. The difference here is that coefficients are convolved and summed together to produce composite front and rear beamforming filters that produce the same audio output as FIG. 13, within the numerical precision of the processing. Mathematically this can be written as:

$$\mathrm{FBF}=(\mathrm{FMF}*\mathrm{LFC}+\mathit{FPF}*\mathrm{HFC})*\mathrm{OMF} \tag{8}$$

$$\mathit{R}\mathrm{BF}=(\mathit{R}\mathrm{MF}*\mathrm{LFC}+\mathit{RPF}*\mathrm{HFC})*\mathrm{OMF} \tag{9}$$

where:

"*" equals convolution,

FBF=the composite of the first beamforming filter 302 coefficients of FIG. 14;

RBF=the composite of the second beamforming filter 304 coefficients of FIG. 14;

FMF=the first microphone model filter 1302 coefficients;

RMF=the second microphone model filter 1304 coefficients;

FPF=the idealized microphone polar pattern coefficients 310;

RPF=the idealized microphone polar pattern coefficients 310;

HFC=the high frequency crossover filter 1404 coefficients;

LFC=the low frequency crossover filter 1406 coefficients; and

OMF=the high frequency on-axis microphone model filter 1144 coefficients.

The first beamforming filter 302 and the second beamforming filter 304 are convolved with a high frequency on-axis microphone model filter 1144 and the sum of the output of a high frequency crossover filter 1404 and a low frequency crossover filter 1406. The user polar pattern control 128 determines the coefficient values selected by the table of idealized microphone polar pattern coefficients 310 that determines the coefficient values of the high frequency crossover filter 1404. The table of idealized microphone polar pattern coefficients 310 is mapped by microphone polar pattern type. The user microphone type selection control 316 determines the values of the table of low frequency microphone model coefficients 1224 and a table of high frequency on-axis microphone model coefficients 1148. The table of low frequency microphone model coefficients 1224 determines the coefficient values of the low frequency crossover filter 1406. The table of low frequency microphone model coefficients 1224 maps coefficients based on the low frequency response of the selected microphone emulation. For example, if a Neumann U47 FET were selected by the user microphone type selection control 316, then the coefficients would map the low frequency response of a Neumann U47 FET microphone. The table of high frequency on-axis microphone model coefficients 1148 determines the value of the on-axis model filter, as previously described. The table of high frequency on-axis microphone model coefficients 1148 maps coefficients based on the on-axis high frequency response of the selected microphone emulation.

An alternate approach for the coefficient generation in this embodiment is to use a least squares design procedure to create the crossover filter coefficients. If, for example, first order IIR shelf filters are used for the crossover, then the gain can be independently adjust at low and high frequencies. The transition region between low and high will be set by the "cut-off" frequency of the IIR filter and will have a maximum slope of 6 dB per octave. For a two capsule design this becomes a 2×2 least squares optimization problem to design a set of crossover filters which produce the desired low and high frequency polar pattern. The optimization procedure is essentially the same as previously described.

FIGS. 15A-B show a system and method capable of producing idealized high frequency polar patterns and user selectable microphone models with automatic proximity correction where the microphones signals are converted to omni-directional and figure-eight polar patterns before further processing. The high frequency and low frequency components of the microphone signal are applied to separate modeling filters. The microphone signal is also divided into a figure-eight and an omni-directional component. Since the proximity-effect only affects the low frequency portion of the figure-eight component (i.e. the velocity component), a figure-eight low frequency model filter can be used to automatically equalize the proximity-effect to that of the desired modeled microphone.

Referring to FIGS. 15A-B, the front capsule 102, the rear capsule 104, the first compensation filter 106, the second compensation filter 108, third compensation filter 118, a fourth compensation filter 120, first linear gain stage 122, and the second linear gain stage 124 are arranged in combination, as described in FIG. 1, resulting in the summed signal 132, designated by node "E", across FIGS. 15A-B, with a compensated polar pattern determined by the user polar pattern control 128, and the polar pattern lookup table 126, also as described for FIG. 1. A high frequency crossover filter 1502 processes the summed signal and passes a high frequency content output signal 1504. A high frequency on-axis microphone model filter 1144 processes the high frequency content output signal 1504. The high frequency on-axis microphone model filter 1144 is controlled by the high frequency on-axis microphone model coefficients 1148 based on the selection made by the user with the user microphone type selection control 316. The control path 1508 of the user microphone type selection control 316 is designated across FIGS. 15A-B by node "F."

An omni-directional low frequency microphone model filter 1510 receives a portion of the signal path of the third compensation filter 118. A figure-eight low frequency microphone model filter 1512 receives a portion of the signal path of the fourth compensation filter 120. A table of user microphone type low frequency coefficients 1514 determines the coefficient values of the omni-directional low frequency microphone model filter 1510 and the figure-eight low frequency microphone model filter 1512.

The output of the omni-directional low frequency microphone model filter 1510, designated across FIGS. 15A-B by node "G", is summed 1516 with the output of the figure-eight low frequency microphone model filter 1512. The figure-eight low frequency microphone model filter 1512 is designated by node "H" across FIGS. 15A-B. A low frequency crossover filter 1520 filters the resultant summed signal 1521. The low frequency crossover filter 1520 and the high frequency crossover filter 1502 have complementary crossover points. The output of the low frequency crossover filter 1520 and the high frequency crossover filter 1502 are summed 1522 creating an audio output 1524 that has automatic proximity-effect equalization, a user selectable polar pattern with idealized on and off-axis polar responses where the on-axis response can be adjusted independently of the off-axis response to emulate a microphone model selected by the user.

The omni-directional low frequency microphone model filter 1510 and the figure-eight low frequency microphone model filter 1512 coefficients are derived in the same manner as FIG. 11B. The crossover filter coefficients are derived as previously stated for FIGS. 13 and 14. The coefficients of the high frequency on-axis microphone model filter 1144 are equivalent to other mentioned embodiments.

FIGS. 16A-B shows a system and method capable of producing idealized polar patterns and user selectable microphone models with full proximity compensation utilizing a two-dimensional lookup table 1602. In this case, all of the different off-axis distance and polar pattern coefficients are in the two-dimensional lookup table 1602, in order to facilitate both off-axis proximity corrections in combination with idealized polar patterns. This can be achieved by measuring the polar response at numerous distances, which allows the creation of a set of beamforming filters at each user controlled distance.

Referring to FIGS. 16A-B, the front capsule 102 and the rear capsule 104 are placed back-to-back, as previously described. The first beamforming filter 302 filters the front capsule 102 signal and a second beamforming filter 304 filters the rear capsule 104 signal. The resultant signals are summed 306 together to produce an output with an idealized polar pattern that has also been partially compensated for off-axis proximity-effect. The two-dimensional lookup table 1602 determines the coefficient values for the first beamforming filter 302 and the second beamforming filter 304. The polar pattern selected by the user polar pattern control 312 determines which row of the two-dimensional lookup table 1602 is selected and the off-axis distance control 1604 determines which column of the two-dimensional lookup table 1602 is selected. As previously discussed, the use the terms row and columns to describe a two-dimensional lookup table is for illustrative purposes to describe for example, two-dimensional arrays and other similar data structures.

One method for generating the table coefficients is to use the same method described previously related to FIG. 3, but repeat the method for every distance entry in the table. This is done by taking microphone measurements at each stipulated distance, and then performing one of the aforementioned optimization algorithms repeatedly until the table is filled.

The user polar pattern control 312 selects the coefficient value k in the polar pattern lookup table 126. As previously described for an omni-directional pattern, k=0, for a figure-eight polar pattern, k=1, for a cardioid polar pattern k=0.5, for other patterns k can be take on a value between 0 and 1. In addition to selecting the column of the two-dimensional lookup table 1602, the off-axis distance control 1604 controls the off-axis distance coefficient table 1214.

FIG. 16B is identical to FIG. 11B, expect for the labels of the connections between figures. The resultant output 1607 is designated across FIGS. 16A and 16B by node "K." The output of polar pattern lookup table 126 is designated across FIGS. 16A and 16B by node "L." And the off-axis distance coefficient table 1214 is designated across FIGS. 16A and 16B by node "M."

The system and methods of FIGS. 1-16 utilize two microphone capsules. A system and method capable of producing idealized polar patterns and user selectable microphone model can be extended to more than two capsules. This allows for the generation of more ideal polar patterns or polar patterns with higher directionality. With three or more capsules it is possible to generate a wider selection of polar patterns including second order gradients. The polar pattern of a second order gradient microphone is composed of zeroth, first and second order spherical harmonics. The zeroth order is equivalent to the omni-directional polar pattern, and the first order is equivalent to the figure-eight polar pattern.

A figure-eight output is proportional to the velocity of the soundfield in the on-axis direction. Since velocity can be measured in three dimensions (up/down, left/right, and front/back), so as many as three orthogonal figure-eight outputs can be used to capture the soundfield. A three capsule microphone can generate an omni-directional plus two orthogonal figure-eight polar patterns. A four capsule tetrahedral soundfield microphone can generate omni-directional polar pattern plus three orthogonal figure-eight polar pattern components.

FIG. 17 shows a system and method capable of producing idealized polar patterns and user selectable microphone models utilizing three microphone capsules, which can be omni, cardioid or variations in between. A first capsule 1700, a second capsule 1701, and a third capsule 1702 are mounted in an approximately coincident setup. The exact configuration of the capsules can be any one of numerous possibilities. A specific example is two back-to-back cardioid capsules with a figure-eight capsule positioned just behind rear cardioid capsule. The a first beamforming filter 302 receives the output signal from the first capsule 1700, a second beamforming filter 304 receives the output signal from the second capsule 1701, and a third beamforming filter 1704 receives the output signal from the third capsule 1702. Each filter shapes the signal from the corresponding microphone capsule so that the summed signal 1706 that results from summing the output of the first beamforming filter 302, the second beamforming filter 304, and the third beamforming filter 1704, has a polar pattern determined by the polar pattern selected by the user polar pattern control 312. A polar pattern lookup table 1708 maps a set of coefficients to each beamforming filter based on the polar pattern selected by the user polar pattern control 312. With three capsules, there are many more polar patterns possible than with two capsules.

The on-axis microphone model filter 314 receives the summed signal 1706 and modifies the on-axis frequency response as to emulate a user selected microphone model selected by the user microphone type selection control 316 resulting in the audio output 320. The audio output 320 has an idealized on-axis and off-axis polar pattern response with an on-axis response modified to emulate the user selected microphone model. The coefficients of the on-axis microphone model filter 314 are mapped from the user microphone type selection control 316 through the table of on-axis microphone model coefficients 318 as previously described in this disclosure.

The system and method of FIG. 17 can be easily extended to a microphone with more than three capsules by increasing the number of beamforming filters and adjusting the coefficient values within the polar pattern lookup table 1708 to account for the additional capsule elements. For example, if using the least squares method as previously described, adding more capsules requires increasing the dimensions of the A, C and H matrices corresponding to the number of capsules. Then H will consist of a set of filters with one for each capsule.

In the first order gradient case idealized polar pattern beamforming filter coefficients can be determined by optimizing the measured capsule response to best match the ideal first order polar response corresponding to the gain function: $(1-k)+k\cdot\cos(x)$. For the second order case there are many more possible gain functions. One possible gain function, for example, is: $g=1/((a+1)(b+1))$ $gain=g(a+\cos(x))(b+\cos(x))$ where a and b are variables that specify the polar pattern in a way that is similar to the first order case and g is a normalization factor so the on-axis level remains constant as the polar patter is adjusted. By creating a set of desired polar patterns with this method the optimizer can then create beamforming filters that match the desired patterns as closely as possible.

FIGS. 18A-B show a system and method capable of producing idealized $1^{st}$ and $2^{nd}$ order polar patterns and user selectable microphone models with proximity correction utilizing three microphone capsules. In a second order gradient microphone proximity-effect is accentuated. The inverse square law component in a first order gradient microphone rises at about 6 dB per octave at low frequencies. For a second order gradient microphone the rise is about 12 dB per octave, therefore different correction filters are needed for the second order spherical harmonics.

Referring to FIGS. 18A-B, the system includes a microphone that includes three microphone capsules, a first capsule 1802, a second capsule 1804, and a third capsule 1806. As mentioned, with three capsules present, it is possible to generate polar patterns with second order gradients depending on how the capsules are configured. Second order gradient microphone responses are composed of spherical harmonics up to order two. This potentially includes the zeroth order harmonic which corresponds to the omni-directional response, three first order harmonics which correspond to figure-eight patterns for each spatial dimension, and five second order spherical harmonics. There are nine beamforming filters, three for each microphone capsule to shape the polar pattern based on these spherical harmonics. The beamforming filters include, a first omni-directional beamforming filter 1808, a second omni-directional beamforming filter 1810, a third omni-directional beamforming filter 1812, a first figure-eight beamforming filter 1814, a second figure-eight beamforming filter 1816, and a third figure-eight beamforming filter 1818, a first second-order beamforming filter 1820, a second second-order beamforming filter 1822, and a third second-order beamforming filter 1824. The first omni-directional beamforming filter 1808, the first figure-eight beamforming filter 1814, and the first second-order beamforming filter 1820 receive their signal from the first capsule 1802. The second omni-directional beamforming filter 1810, the second figure-eight beamforming filter 1816, and the second second-order beamforming filter 1822 receive their signal from the second capsule 1804. The third omni-directional beamforming filter 1812, the third figure-eight beamforming filter 1818, and the third second-order beamforming filter 1824, receive their signal from the third capsule 1806.

The outputs of the first omni-directional beamforming filter 1808, the second omni-directional beamforming filter 1810, and the third omni-directional beamforming filter 1812 form a first summed signal 1826. The outputs of the first figure-eight beamforming filter 1814, the second figure-eight beamforming filter 1816, and the third figure-eight beamforming filter 1818 form a second summed signal 1828. The outputs of the first second-order beamforming filter 1820, the second second-order beamforming filter 1822, and the third second-order beamforming filter 1824 form a third summed signal 1830.

The coefficient values of the beamforming filter are selected from a polar pattern lookup table 1831 based on a polar pattern selected by the user with the user polar pattern control 1832. Because the microphone has three capsules, there are additional polar patterns available when compared with a two capsule microphone. Referring to FIG. 19, a second order polar pattern 1902 is plotted against a cardioid polar pattern 1904. This is one example of many second polar patterns that can be realized. The second order gradient polar plot shown in FIG. 19 comprises equal parts figure-eight and second order gradient. The gain function is:

$$\cos(x)+\cos(x)^2 \tag{10}$$

The first term in the equation (10) corresponds to the figure-eight component and the second term in equation (10) corresponds to the second order gradient component, where x is the angle of incidence.

Referring again to FIG. 18, an inverse off-axis first order proximity filter 1834 compensates for proximity-effect for the second summed signal. The inverse can be created by inverting the poles and zeros of an off-axis first order proximity filter. An inverse off-axis second order proximity filter 1836 compensates for proximity-effect for the third summed signal 1830. The output of the inverse off-axis first order proximity filter 1834, the output of the inverse off-axis second order proximity filter 1836, and the first summed signal 1826 are summed 1838 resulting in a summed signal 1840. The summed signal 1840 has an idealized on and off-axis polar pattern that is compensated for off-axis proximity-effect. The node "M" designates the summed signal 1840 between FIGS. 18A and 18B.

The inverse off-axis first order proximity filter 1834 and the inverse off-axis second order proximity filter 1836 both have their coefficient values determined by a lookup table of an off-axis proximity filter distance coefficients 1842. The coefficients selected within the table are determined by the user off-axis distance control 1844.

The inverse off-axis first order proximity filter 1834 coefficients are generated in the same manner as previously described. The inverse off-axis second order proximity filter 1836 uses a similar approach by adjusting the gain of a low-pass filter that models the inverse square law component of the second order gradient. A second order 12 dB octave IIR filter is a reasonable approximation. The amount of this low-pass filter which is summed with the unity gain input signal can be derived empirically based on measurements at various distances or using an optimization algorithm as previously described. The output of the lookup table of off-axis proximity filter distance coefficients 1842 is shown across FIGS. 18A and 18B as node "N." The output of the user polar pattern control 1832 is shown across FIGS. 18A and 18B as node "O."

An omni-directional low frequency model filter 1868, a figure-eight low frequency microphone model filter 1870, and a second order low frequency microphone model filter 1874 receives the summed signal 1840. An on-axis first order proximity filter 1872 receives the output of figure-eight low frequency microphone model filter 1870. An on-axis second order proximity filter 1876 receives the output of the second order low frequency microphone model filter 1874. The output of the omni-directional low frequency model filter 1868, the on-axis first order proximity filter 1872, and the on-axis second order proximity filter 1876 are summed 1878 resulting in a summed signal 1880.

A table of microphone model low frequency coefficients table 1882 controls the omni-directional low frequency model filter 1868, the figure-eight low frequency microphone model filter 1870, and the second order low frequency microphone model filter 1874. The user microphone type control 1898 selects which set of coefficients are used from the microphone model low frequency coefficients table 1882. The second order low-frequency microphone model filter is simplified to handle the sum of all second order harmonics, although this could be expanded to have a microphone model filter for each second order term as there are five possible second order harmonics.

A table of on-axis proximity filter distance coefficients 1892 determines the coefficients for the on-axis first order proximity filter 1872, the on-axis second order proximity filter 1876, and the proximity compensation filter 1886. The table of on-axis proximity filter distance coefficients 1892 is controlled by the user on-axis distance control 1894.

A proximity compensation filter 1886 receives the summed signal 1880. The coefficients for this filter are determined by the table of on-axis proximity filter distance coefficients 1892, the table of off-axis proximity filter distance coefficients 1842, and the kO, kF, k2 coefficient table 1855. The z-domain equation for the proximity compensation filter 1886 is: H(z)=1/(kO+kF*(First Order On-Axis Proximity)*(Inverse First Order Off-Axis Proximity)+k2*(Second Order On-Axis Proximity)*(Inverse Second Order Off-Axis Proximity)).

The values of kO, kF, and k2 are determined by a table of k value coefficients 1855. The values of kO, kF, and k2 are selected by the user polar pattern control 1832. The values of kO, kF, and k2 can be determined within the table by decomposing the desired polar pattern into zeroth, first and second order components. For example, if we use the previously disclosed second order gain function, gain=g·(a+cos(x))(b+cos(x)) can be decomposed into these three components:

$$\text{gain}=g(a\cdot b+(a+b)\cdot\cos(x)+\cos(x)^2). \tag{11}$$

Therefore in this case: kO=g·a·b, kF=g·(a+b) and k2=g. If a first order polar pattern is selected then k2=0 because there is no second order component and kO=1−k, kF=k as is the case with previously stated embodiments.

A high frequency on-axis model filter 1888 receives the resultant output of the proximity compensation filter 1886. The output of the high frequency on-axis model filter 1888 results in the audio output 320. The table of high frequency on-axis microphone model coefficients 1148 determines the coefficients of the high frequency on-axis microphone model filter 1144. The table of high frequency on-axis microphone model coefficients 1148 is controlled by the user microphone type control 1898. The user microphone type control 1898 allows the user to emulate classic microphones as well as system-defined frequency responses as previously described. The coefficients of the high frequency on-axis model filter 1888 are determined by the previously described method.

The system, apparatus, and methods described in FIGS. 3-18 can be implemented using a combination of a microphone with the described capsule configurations and can be implemented within a dedicated hardware device or within the microphone itself. FIG. 20 illustrates a typical hardware implementation. A microphone 2002 includes front capsule 102 and rear capsule 104 configured as previously described. A first microphone pre-amplifier 2004 receives the audio signal from front capsule 102. A second microphone pre-amplifier 2006 receives the audio signal from the rear capsule 104. An analog to digital converter (ADC) 2008 receives the output signal from the first microphone pre-amplifier 2004 and the second microphone pre-amplifier 2006 and converts the analog signals to a digital signal. A processor 2010 receives the signal from the ADC 2008 and implements one or more of the algorithms described in FIGS. 3-18. For the purpose of this disclosure, processor can mean a microprocessor, microcontroller, digital signal processor (DSP), field programmable logic array (FPGA), application specific integrated circuit (ASIC), or similar devices that are capable of real-time or dynamically processing of digital audio signals.

The resulting output can be offered to the user as an analog, digital, or digital wireless signal. For example, a wireless protocol device 2012, such as 802.11 protocol device, can process the output of the processor 2010, resulting in a wireless output 2014. Alternatively, the output can be processed by a digital to analog converter (DAC) 2016, buffered 2018 and presented as an analog output 2020. The output can also be a wired digital computer protocol such as FireWire, Ethernet, USB, or Thunderbolt. The output can also be a digital audio output protocol such as MADI, AES/EBU, or S/PDIF. For example, a USB driver 2022 can convert a serial output from the processor 2010 to a USB output 2024.

User controls, such as the user polar pattern control 312, user microphone type selection control 316, or the user off-axis distance control 1106, shown in previous figures, can be implemented as hardware controls such as switches, potentiometers, or encoders. Alternatively, they can be implemented as virtual controls on a touch screen surface.

The hardware implementation described for FIG. 20 utilized a processor 2010 to carry out the described algorithm of FIGS. 3-18. The lookup tables and software routines can be implemented in internal or external memory and permanently stored in a non-volatile memory such as flash memory. The described algorithms of FIG. 3-18 can be implemented using any processing device capable of processing real-time audio algorithms, for example, a DSP, microprocessor, microcontroller capable of audio digital signal processing, FPGA, CPLD, or ASIC. The ADC 2008 and DAC 2016 can be combined within the processor 2010, DSP, microprocessor, microcontroller, or mixed signal FPGA. The digital protocol processing while shown as external devices can also be implemented within the processor 2010, DSP, microprocessor, microcontroller, or mixed signal FPGA.

The system, apparatus, and methods described in FIGS. 3-18 can be implemented using a combination of a microphone with the described capsule configurations and software implemented on a personal computer or tablet computer, or a mobile device. For example, the software can be a standalone software application, or plug-in for audio or video applications, such as Virtual Studio Technology (VST) plugin, Audio Unit (AU), or Real Time Audio Suite (RTAS). The described controls can be implemented as virtual controls in a graphical user interface.

FIG. 21 shows a system capable of producing idealized polar patterns and user selectable microphone models implemented with software running on a personal computer in combination with an external microphone. Referring to FIG. 21, microphone 2102 can includes the front capsule 102 and rear capsule 104. An ADC 2104 converts the microphone's analog output into a digital signal. A computer 2106 receives the digital signal from the ADC 2104. The output of the ADC 2104 can be in the form of a wired computer protocol, for example, Ethernet, USB, FireWire, or Thunderbolt. The output of the ADC 2104 can also be in the form wireless computer protocol such as 802.11 or 802.15.

Alternatively, the ADC 2104 can be placed inside the microphone and a digital signal from the microphone 2102 can be received directly by the computer 2106. For example, the microphone can have a wired digital output, using a computer digital protocol such as Ethernet, USB, FireWire, or Thunderbolt. The computer 2106 can have a wireless digital output using wireless digital protocol such as 802.11 or 802.15.

The controls, such as the user polar pattern control 312 or the user microphone type selection control 316, can be implemented on the computer or tablet device's graphical user interface 2108 and manipulated a computer keyboard 2110 or by a point and click device 2112 such as a mouse or touch pad, or directly if the computer or tablet device has a touch screen.

FIG. 22 shows an apparatus, in partial cutaway view, for producing user selectable on-axis microphone models combined with idealized polar responses, which is encompassed within a microphone housing 2202. Shown are two back-to-back microphone capsules, the front capsule 102 and the rear capsule 104. Other capsule configurations described for FIGS. 3-18 can be substituted. A user interface, allows for adjustment of various parameters disclosed, for example, such as the polar pattern type, microphone type, or microphone angle. The illustrated user interface includes a display 2204, a rotary control 2206, and a first selector button 2208 and a second selector button 2210. The display 2204 can be LCD, LED, oLED, and other visual displays capable of displaying text information. The rotary control 2206 can be a pulse potentiometer, a rotary encoder, a potentiometer, or other rotary controls adaptable to be have their relatively position read by a microprocessor, DSP, microcontroller, or FPGA. The rotary control 2206 can be used to scroll through various selections, for example, polar pattern types, or microphone types. The first selector button 2208 can be used to select the desired selection option; the second selector button 2210 can be used as to navigate the main menu or as a back or escape button.

A DSP 2212 within the microphone housing 2202 processes the algorithms for producing user selectable on-axis microphone models combined with idealized polar responses, as previously described. A microprocessor, FPGA, CPLD, or ASIC, capable of real-time processing of audio signals can be used in place of the DSP. The DSP 2212, the display 2204, the first selector button 2208, the second selector button 2210, and rotary control 2206 are mounted on a printed circuit board 2214. The resulting output can be analog or digital and produced in a manner previously described. An output portion 2216 can include a wired connector such as an XLR connector, USB connector, FireWire connector, or Thunderbolt connector. The output portion 2216 can also include a wireless antenna. The microphone models and polar pattern responses can be updated from the Internet or a computer via a wired or wireless interface within the output portion 2216. The circuitry of FIG. 22 can be powered internally by batteries or can be externally powered. For example, it may be possible to power the microphone circuitry through the use of the digital phantom power standard, AES42.

The apparatus of FIG. 22 is one example of a microphone-enclosed implementation of a system and apparatus for producing user selectable on-axis microphone models combined with idealized polar responses. Other implementations are possible. FIG. 23 shows an alternative implementation of microphone-enclosed implementation of a system and apparatus for producing user selectable on-axis microphone models combined with idealized polar responses. Referring to FIG. 23, the and apparatus for producing user selectable on-axis microphone models combined with idealized polar responses is enclosed within the microphone housing 2202 with a DSP 2212 and printed circuit board 2214, front capsule 102, the rear capsule 104, and the output portion 2216 as previously described. The user interface includes a first rotary control 2302 and a second rotary control 2304. The first rotary control 2302 and the second rotary control 2304 can be used as the user polar pattern control 312 or the user microphone type selection control 316 in FIG. 3. Each rotary control includes a selection indicator, for example, a molding mark, a silk-screened line, or a hot stamped marking. Indicia surround the molding marks. The illustrated indicia are simple lines. The indicia can also include text or symbolic indicators, for example, symbols indicating polar pattern shapes, or numerals or text indicating microphone types.

A system, device, and method for producing user selectable on-axis microphone models combined with idealized polar responses have been described. It is not the intent of this disclosure to limit the claimed invention to the examples, variations, and exemplary embodiments described in the specification. It should be noted that separate linear filter blocks can in general be combined into a single filter. In part they are described as separate filters for increase clarity. In general the linear filter blocks can be reordered without changing the overall effect of the algorithm.

Those skilled in the art will recognize that variations will occur when embodying the claimed invention in specific implementations and environments. For example, it is possible to implement certain features described in separate embodiments in combination within a single embodiment. Similarly, it is possible to implement certain features described in single embodiments either separately or in combination in multiple embodiments. It is the intent of the inventor that these variations fall within the scope of the claimed invention. While the examples, exemplary embodiments, and variations are helpful to those skilled in the art in understanding the claimed invention, it should be understood that, the scope of the claimed invention is defined solely by the following claims and their equivalents.

What is claimed is:

1. A method for producing user selectable on-axis microphone models combined with idealized polar responses, including:

creating a user selected idealized on-axis and off-axis polar response from a plurality of microphone capsule signals;

emulating a user selected on-axis microphone model frequency response; and adjusting the user selected idealized on-axis and off-axis polar response substantially independent from the user selected on-axis microphone model frequency response.

2. The method of claim 1, further including:

emulating the user selected on-axis microphone model frequency response is carried out by an on-axis microphone model filter; and applying a set of microphone model type coefficients to the on-axis microphone model filter.

3. The method of claim 2, wherein:

creating the user selected idealized on-axis and off axis polar response from the plurality of microphone capsule signals is carried out by a plurality of corresponding beamforming filter.

4. The method of claim 1 further including:

producing the user selected idealized on-axis and off-axis polar response from the plurality of microphone capsule signals and emulating the user selected on-axis microphone model frequency response are carried out by a plurality of beamforming filters; and applying a set of coefficients to the plurality of beamforming filters that model a user selected combination of the user selected idealized on-axis and off-axis polar response and the user selected on-axis microphone model frequency response.

5. The method of claim 1, further including:

compensating for a proximity-effect due to the plurality of microphone capsule signals.

6. The method of claim 5 wherein compensating for the proximity-effect due to the plurality of microphone capsule signals is carried out by convolving a plurality of beamforming filters with a high frequency on-axis model filter and a sum of a high frequency and a low frequency crossover filter.

7. The method of claim 5, further including:

creating a high frequency component of the user selected idealized on-axis and off-axis polar response;

creating a low frequency component of the user selected on-axis microphone model frequency response; and applying a microphone model filter to the high frequency component.

8. The method of claim 1, further including:

applying a proximity filter is applied to a first order gradient component of a linear combination of the plurality of microphone capsule signals.

9. The method of claim 8, further including:

applying a second order proximity filter to a second order gradient component of the linear combination of the plurality of microphone capsule signals.

10. The method of claim 1, further including:

emulating a user selected angle of rotation frequency response with respect to an axis position of a modeled microphone.

11. A microphone, including:

a plurality of microphone capsules; and a processor for receiving and acting on a plurality of microphone capsule signals, the processor configured to:

(a) produce an idealized on-axis and off-polar pattern response based on a user-selected polar pattern type, and (b) emulate a user selected on-axis microphone model frequency response; and (c) adjust the idealized on-axis and off-axis polar response substantially independent from the user selected on-axis microphone model frequency response.

12. The microphone of claim 11, wherein the user-selected polar pattern type and a user selected on-axis microphone model are selected externally from the microphone.

13. The microphone of claim 11, wherein the processor is further configured to adjust a microphone model frequency response to simulate rotation of the microphone with respect to a sound source based on a simulated microphone rotation angle selected by a user.

14. The microphone of claim 11, further including:

the processor is further configured to compensate for a microphone proximity-effect based on a user estimated distance selection.

15. The microphone of claim 11, wherein: the processor is further configured to compensate for an off-axis microphone proximity-effect based on a user selection of estimated off-axis distance and compensate for an on-axis proximity-effect based on a user selection of estimated on-axis distance.

16. The microphone of claim 11, wherein, the processor is further configured to:

produce the idealized on-axis and off-axis polar pattern response based on the user-selected polar pattern type with a plurality of beamforming filters; and emulate the user selected on-axis microphone model frequency response with an on-axis microphone modeling filter.

17. A system for producing user selectable on-axis microphone models combined with idealized polar responses, including:

a polar pattern user control for selecting a polar pattern;

a microphone model type user control for selecting a microphone model; and a processor for receiving and acting on a plurality of microphone capsule signals, the processor configured to:

(a) produce an idealized on-axis and off-axis polar pattern response based on a user-selected polar pattern type from the polar pattern user control, and (b) emulates a user selected on-axis microphone model frequency response based on the microphone model selected from the microphone model type user control; and (c) adjust the idealized on-axis and off-axis polar response substantially independent from the user selected on-axis microphone model frequency response.

18. The system of claim 17, further including:

a graphical user interface; and the polar pattern user control and the microphone model type user control are virtual controls on the graphical user interface.

19. The system of claim 17, further including:

a user microphone model axis control; and the processor further configured to adjust a microphone model frequency response to simulate rotation of a modeled microphone with respect to a sound source based on a user selection of the user microphone model axis control.

20. The system of claim 17, further including:

a user microphone model physical axis control;

a user microphone model virtual axis control; and the processor further configured to adjust a microphone model frequency response to simulate rotation of a modeled microphone with respect to a sound source based on a user selection of the user microphone model virtual axis control and the user microphone model physical axis control.

21. The system of claim 17, further including:

a user distance control; and the processor is further configured to compensate for a microphone proximity-effect based on a user selection from the user distance control.

22. The system of claim 21, wherein:

the user distance control is an on-axis distance control and an off-axis distance control; and the processor is further configured to compensate for an off-axis microphone proximity-effect based on a user selection from the off-axis distance control and reducing an on-axis proximity-effect based on the on-axis distance control.

23. The system of claim 17, wherein, the processor is further configured to:

produce the idealized on-axis and off-polar pattern response based on the user-selected polar pattern type with a plurality of beamforming filters; and emulate the user selected on-axis microphone model frequency response with a microphone modeling filter.

24. The system of claim 17, wherein the processor is further configured to:

produce the idealized on-axis and off-axis polar response from the plurality of microphone capsule signals and emulate the user selected on-axis microphone model frequency response by a plurality of beamforming filters; and apply a set of coefficients to the plurality of beamforming filters that model a user selected combination of the idealized on-axis and off-axis polar response and the user selected on-axis microphone model frequency response.

* * * * *